US011472197B2

(12) United States Patent
Rai

(10) Patent No.: US 11,472,197 B2
(45) Date of Patent: Oct. 18, 2022

(54) BRAILLE PRINTER WITH BRAILLE PRINTING HEAD AND METHOD OF PRINTING BRAILLE CHARACTERS

(71) Applicant: Khushwant Rai, Punjab (IN)

(72) Inventor: Khushwant Rai, Punjab (IN)

( * ) Notice: Subject to any disclaimer, the term of this patent is extended or adjusted under 35 U.S.C. 154(b) by 342 days.

(21) Appl. No.: 16/323,085

(22) PCT Filed: Aug. 2, 2017

(86) PCT No.: PCT/IB2017/001099
§ 371 (c)(1),
(2) Date: Feb. 4, 2019

(87) PCT Pub. No.: WO2018/025082
PCT Pub. Date: Feb. 8, 2018

(65) Prior Publication Data

US 2019/0160831 A1 May 30, 2019

(30) Foreign Application Priority Data

Aug. 3, 2016 (IN) ..... 201611026550

(51) Int. Cl.
*B41J 3/32* (2006.01)

(52) U.S. Cl.
CPC ..... *B41J 3/32* (2013.01)

(58) Field of Classification Search
CPC ..... B41J 3/32; G09B 21/02
USPC ..... 400/109.1
See application file for complete search history.

(56) References Cited

U.S. PATENT DOCUMENTS 5,209,584 A * 5/1993 Galarneau ..... B41J 3/32 101/18
5,746,518 A * 5/1998 Ogawa ..... B41J 3/32 400/109.1
2006/0193669 A1 8/2006 Takada
2007/0160404 A1* 7/2007 Yin ..... B41J 3/32 400/109

FOREIGN PATENT DOCUMENTS

DE 10 210 013828 3/2012
JP 2006212921 8/2006

OTHER PUBLICATIONS

PCT/USIB2017/001099 International Search Report and Written Opinion, dated Jan. 15, 2018.

* cited by examiner

*Primary Examiner* — Leslie J Evanisko

(57) ABSTRACT

Improved Braille printers and Braille printer components for embossing Braille characters onto a paper substrate are disclosed. Methods of making using Braille printers and Braille printer components to form Braille characters on a paper substrate are also disclosed.

19 Claims, 15 Drawing Sheets

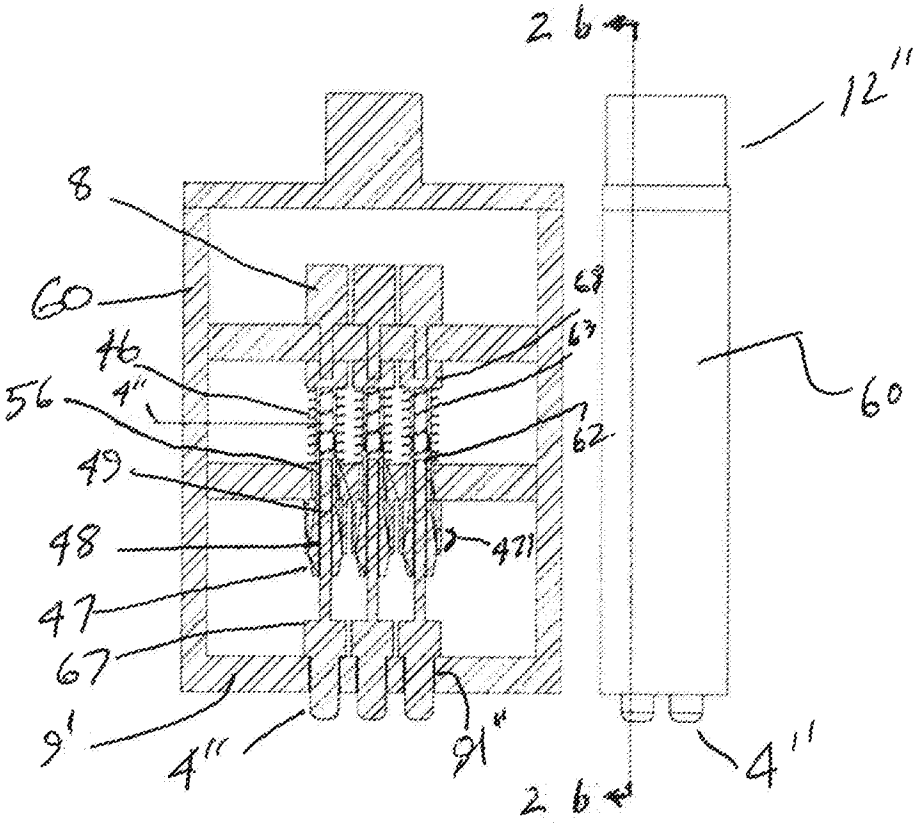
FIG. 27a
FIG. 27b
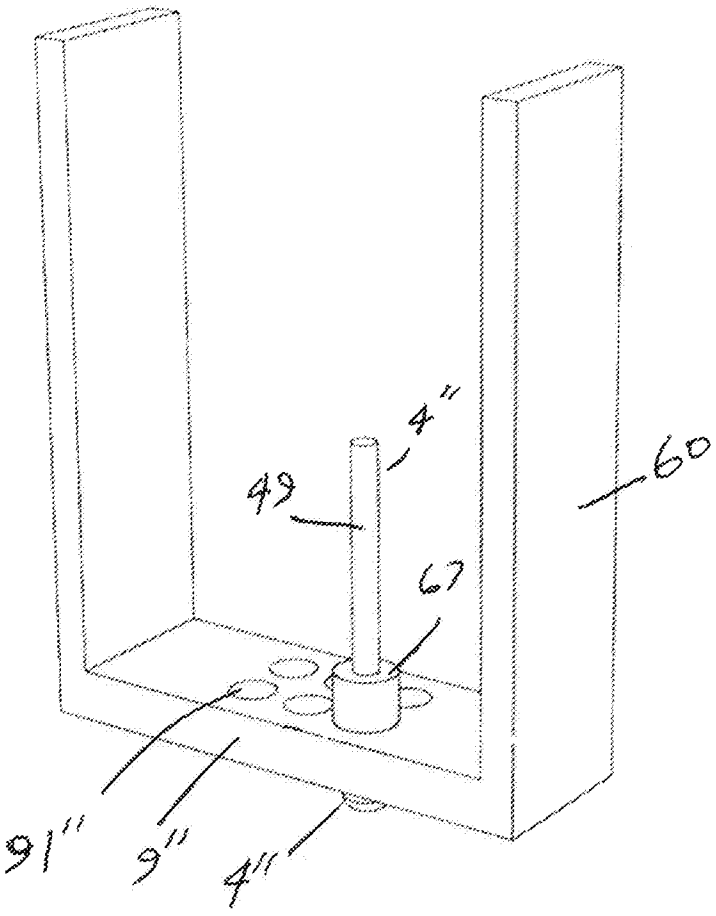
FIG. 26

BRAILLE PRINTER WITH BRAILLE PRINTING HEAD AND METHOD OF PRINTING BRAILLE CHARACTERS

This application is being filed as the national stage patent application of PCT International Patent Application No. PCT/IB2017/001099, filed on 2 Aug. 2017, and claims the benefit of and priority to Indian Provisional Patent Application Serial Number 201611026550, filed on 3 Aug. 2016, the contents of which are incorporated by reference herein in their entirety.

FIELD OF THE INVENTION

The present invention is directed to low cost Braille printers and Braille printer components. The present invention is further directed to methods of making and using low cost Braille printers and Braille printer components.

BACKGROUND OF THE INVENTION

Braille is a tactile writing system used by people who are blind or visually impaired. It is traditionally written with embossed paper.

The Braille system, devised in 1821 by Frenchman Louis Braille, is a method that is widely used by blind people to read and write. Braille is a system of touch reading and writing used by blind persons. Embossed dots are evenly arranged in quadrangular letter spaces, called cells.

Each Braille character or cell is made up of six dot positions, arranged in a rectangle containing two columns of three dots each. A dot may be raised at any of the six positions to form sixty-four combinations, including the combinations in which only some relevant dots are raised.

A cell consists of six dots arranged in the form of a rectangular grid of two dots horizontally and three dots vertically.

A full cell is three dots high and two dots wide. Each cell may contain up to six dots. Only 63 different characters can be formed. Braille is a fixed-width font meaning that every character occupies the same amount of space, regardless of how many dots are in the cell. For Braille to be read by a blind person, the dots of each cell must be easily discernible by touch i.e., high sentience and the height of the dots must be sufficient to be easily distinguishable from the background i.e., high readability.

Braille Dot height is approximately 0.02 inches (0.5 mm); the horizontal and vertical spacing between dot centers Within a Braille cell is approximately 0.1 inches (2.5 mm); the blank space between dots on adjacent cells is approximately 0.15 inches (3.75 mm) horizontally and 0.2 inches (5.0 mm) vertically. A standard Braille page is 11 inches by 11.5 inches and typically has a maximum of 40 to 43 Braille cells per line and 25 lines The US patent publication U.S. Pat. No. 5,823,691A discloses an embossing device which can produce crisp, well-defined images on a suitable sheet material, such as stiff paper. The device can produce embossed images of graphical subjects such as maps, drawings and the like, in addition to producing traditional six or eight dot Braille cells and Dotsplus Braille cells.

The Chinese publication CN 2780466Y discloses a utility model having a printer body and set including a computer connected to the printer body, print roller and the printer head, which is characterized by the creation of Braille, Braille generating groove on the platen roller, equal to the settings on the printer and print needle roller co-operating with two print needles, and the needle diameter print Braille generation vessel diameter.

The US patent publication U.S. Pat. No. 5,746,518A discloses a Braille printing apparatus which includes a pin-shaped projection employed as a debossing die. A printing underlay is employed as an embossing die, and is made of an elastic material. Different projections with different depressing depths can also be provided, to optionally address different recording mediums, including of different thicknesses.

The US patent publication U.S. Pat. No. 4,930,914A discloses an apparatus for making tactile impressions on paper. The apparatus includes a plurality of pins, a driver, and a print wheel. The driver selectively extends a pin toward the paper. The print wheel then presses the paper and pin in close contact. As a result, the pin is forced against the paper by the print wheel and leaves a tactile impression on the paper.

The US patent publication U.S. Pat. No. 5,209,584A discloses a device for forming Braille characters on an embossable substrate comprising a block-like main body having an array of six Braille printing pins actuated by an assembly of plurality of rods and solenoids.

Dot matrix printer (DMP) is a class of printing mechanism. Typically, in these devices, a print head carrying a plurality of impact pins is traversed across the paper and the pins are actuated in an organized sequence to create recognizable print characters. This has been useful for ink printing where the impact force required to transfer the ink from the ribbon to the paper is relatively low. However, in other types of printing, particularly embossing or raised letter printing that is Braille, the impact force is many times greater. In dot matrix printer, pins of the head strike the ribbon with low impact force to produce printing effect. But for Braille printing, pins are required to penetrate into the paper with more impact force as compared to DMP to produce embossing effect.

Due to shortcomings described above, there is a need for an improved Braille printer over the existing dot matrix printer for the visually impaired. The said printer is capable of embossing both sides of the paper without using any ribbon.

SUMMARY OF THE INVENTION

The present invention is directed to low cost Braille printers and Braille printer components. The present invention is further directed to methods of making and using low cost Braille printers and Braille printer components. The newly designed Braille printers and Braille printer components also include operating systems and software developed for the Braille printers and Braille printer components for operation and other features such as print text to Braille conversion.

As discussed herein, the present invention is directed to Braille printer components. In some embodiments, the Braille printer component of the present invention comprises a Braille printing head capable of forming Braille characters on a paper substrate, the Braille printing head comprising: a plurality of strike pins; an impact substrate having at least one strike pin hole therein for each strike pin within the plurality of strike pins to extend through; and a force-providing component, the force-providing component being positioned to apply a force onto the impact substrate so as to move (i) the impact substrate and (ii) one or more selected strike pins within the plurality of strike pins that are engaged with or connected to (and move with) the impact substrate towards a paper substrate to impact the paper substrate and form a Braille character.

In some embodiments, the Braille printer component of the present invention comprises a Braille printing head capable of forming Braille characters on a paper substrate, the Braille printing head comprising: a plurality of strike pins, wherein each strike pin within the plurality of strike pins comprises a strike pin rod having a circular cross-sectional area and an outer rod surface, a strike pin impact end for forming a dot of a Braille character, and at least one strike pin extension extending outward from the outer rod surface, the at least one strike pin extension being configured to be engagable with an impact substrate of the Braille printing head and be movable with the impact substrate towards a paper substrate to impact the paper substrate and form a Braille character.

In some embodiments, the Braille printer component of the present invention comprises a Braille printing head capable of forming Braille characters on a paper substrate, the Braille printing head comprising: a plurality of strike pins, wherein each strike pin within the plurality of strike pins comprises a strike pin rod having a circular cross-sectional area and an outer rod surface, a strike pin impact end for forming a dot of a Braille character, and at least one strike pin component along the strike pin rod that enables the strike pin to be rotated about a dissecting axis extending through the strike pin.

In some embodiments, the Braille printer component of the present invention comprises a Braille printing head capable of forming Braille characters on a paper substrate, the Braille printing head comprising: a plurality of strike pins, wherein each strike pin within the plurality of strike pins comprises a strike pin rod having a circular cross-sectional area and an outer rod surface, a strike pin impact end for forming a dot of a Braille character, a strike pin rod distal end opposite the strike pin impact end, a hollow strike pin tubular member sized so that the strike pin rod distal end and a portion of the strike pin rod proximate the strike pin rod distal end can slide within the hollow strike pin tubular member, and a strike pin holding flap member, positioned along the hollow strike pin tubular member, the strike pin holding flap member being expandable so as to move between (i) a closed locked position in which the strike pin rod is at a fixed location within the hollow strike pin tubular member and (ii) an open unlocked position in which the strike pin rod is slidingly movable within the hollow strike pin tubular member.

In some embodiments, the present invention has a similar mechanism to that of a dot matrix printer, but with modifications in its head and roller mechanism to produce standard embossed Braille characters in a cost effective manner. The major elements in some embodiments of the present invention are: a printing head with a plurality strike of pins, a paper, a metal sleeve engraved with divots (or holes with a size similar to standard Braille dots). In some embodiments, the diameter of a print roller is decreased as compared to an original diameter of a print roller of a dot matrix printer and then is made equal to diameter of the dot matrix roller by sheathing the print roller with a metal sleeve having engraved divots of size of standard Braille dots such that the distance between adjacent die on metal sleeve is same as the distance between dots in standard Braille cell.

d=diameter of roller of dot matrix printer x=thickness of metal sleeve on Braille printer (d−x)=diameter to be reduced Thus, with the metal sleeve, the diameter of the print roller of the Braille printer is made equal to the diameter of roller of dot matrix and strike pins are allowed to strike directly on the paper unlike dot matrix where pins strike on ribbon; the metal sleeve with engraved divots on roller allows Braille dot of standard Braille size to get imprinted on the paper. The pins of existing printing heads of dot-matrix printers cannot penetrate thick paper so, the new Braille printing head of the present invention is designed to create embossed dots on the paper. The printing head contains a plurality of pins, which is controlled, for example, by low-power control electromagnets. It also may contain a force electromagnet that attracts a metallic flap. The metallic flap brings the selected strike pins with required force to penetrate the thick paper. The strike pins are able to penetrate the paper due to the divots on the roller behind them. The printer is interfaced with operating system developed into it which contains application software for formulating pages of Braille text from an input of sight readable alphanumeric data.

The present invention is further directed to Braille printers. The Braille printers of the present invention may comprise one or more of the herein described Braille printer components such as the herein disclosed Braille printing heads, Braille printing strike pins, and print substrates.

The present invention is further directed to methods of making the herein described Braille printer components such as the herein disclosed Braille printing heads, Braille printing strike pins, and print substrates, as well as the herein disclosed Braille printers. In some embodiments, the method of making a Braille printer component comprises a method of making a Braille printing head, the method comprising: forming a Braille printing head capable of forming Braille characters on a paper substrate, the Braille printing head comprising: a plurality of strike pins; an impact substrate having at least one strike pin hole therein for each strike pin within the plurality of strike pins to extend through; and a force-providing component, the force-providing component being positioned to apply a force onto the impact substrate so as to move (i) the impact substrate and (ii) one or more selected strike pins within the plurality of strike pins that are engaged with or connected to (and move with) the impact substrate towards a paper substrate to impact the paper substrate and form a Braille character.

The present invention is even further directed to methods of using the herein described Braille printer components such as the herein disclosed Braille printing heads, Braille printing strike pins, and print substrates, as well as the herein disclosed Braille printers. In some embodiments, the method of using a Braille printer component comprises forming one or more Braille characters on a print substrate, wherein the Braille printer component comprises a Braille printing head capable of forming Braille characters on a paper substrate, the Braille printing head comprising: a plurality of strike pins; an impact substrate having at least one strike pin hole therein for each strike pin within the plurality of strike pins to extend through; and a force-providing component, the force-providing component being positioned to apply a force onto the impact substrate so as to move (i) the impact substrate and (ii) one or more selected strike pins within the plurality of strike pins that are engaged with or connected to (and move with) the impact substrate towards a paper substrate to impact the paper substrate and form a Braille character.

It is an objective of the present invention to provide an improved Braille printer which will be available in the market at a very economical cost affordable by common man, simple- structured and complete-functioned.

It is another objective of the present invention to provide an improved Braille printer with a roller of decreased diameter (as compared to dot matrix) but is sheathed with a metal sleeve of thickness such that overall diameter of the roller is same as that of a dot matrix roller. It is another objective of the present invention to provide an improved Braille printer where metal sleeve on roller has die of size comparable to that of Braille dots engraved on it such that the distance between adjacent die is according to the distance between adjacent dots in the standard Braille cell.

It is another objective of the present invention to provide a modified dot matrix printer for visually impaired in which the strike pins directly strike the paper instead of the ribbon and a metal sleeve with engraved die of standard Braille dots helps to imprint dots on the paper.

It is another objective of the present invention to provide a newly designed printing head which may strike the strike pins with greater force than the force by pins of dot matrix printer, thus producing appropriate embossed effect.

It is another objective of the present invention to provide a printing head in which the plurality of strike pins increases printing speed of the printer.

It is another objective of the present invention to provide an efficient printing head that causes minimum heat dissipation and produces required embossed effect at low cost.

It is another objective of the present invention to strike the plurality of strike pins with one force electromagnet to reduce heat dissipation.

It is yet another objective of the present invention to provide a modified dot matrix printer for visually impaired that allows Braille characters to be printed on both sides of the paper.

The aforementioned and other objects, features and advantages of the present invention will become clear when reference is made to the following description of the preferred embodiments of the present invention, together with reference to the accompanying drawings.

BRIEF DESCRIPTION OF DRAWINGS

Further objectives of the present invention will be more apparent from the description when read in conjunction with the accompanying drawings and where:

FIG. 26 depicts a closer view of an exemplary pin positioned through the exemplary impact plate within the exemplary internal components shown in FIG. 20;

FIG. 27*a* depicts a side view of the exemplary internal components shown in FIG. 20; and FIG. 27*b* depicts a cross-sectional view of the exemplary internal components shown in FIG. 27*a* as viewed along line 27*b*-27*b* shown in FIG. 27*a*.

DETAILED DESCRIPTION

In the following detailed description of the present invention, reference is made to the accompanying drawings, which form a part hereof. In the figures, like referenced numerals identify like elements. The detailed description and the drawings illustrate exemplary embodiments. Other embodiments may be utilized, and other changes may be made, without departing from the spirit or scope of the subject matter presented here. The following detailed description is therefore not to be taken in a limiting sense, and the scope of the claimed subject matter is defined by the description herein and the appended claims.

The present invention meets the aforementioned and other needs by providing an improved Braille printer. In some embodiments, the Braille printer of the present invention comprises a Braille printer, wherein a conventional dot matrix printer is modified, thus embossing Braille characters as per standard Braille size on a paper without use of any ribbon (printing Braille script consist of a pattern of embossed dots on the paper). Unlike dot matrix where pins strike ribbon to produce print, in the Braille printers of the present invention, pins directly strike the paper, which is supported by a modified roller or other print substrate to produce pattern of embossed Braille dots as per standard Braille size on paper.

According to prior art, a Dot Matrix printer for printing ink consists of a printing head, which contains pins forming a matrix wherein the head is attached on a sliding rod and can move along the axis of the rod, a roller to support the paper and moves as the text gets printed via a ribbon, which has ink present on it. The dot matrix printer may have 9 or 24 pins along its circumference. These pins strike over the ribbon with comparatively low impact force and make dots over the paper after striking on the ribbon.

While printing, the position of the ribbon is between the printer head and the paper while the paper is associated to the roller.

The present invention has similar mechanism to that of dot matrix printer but with modifications in its printing head and roller mechanism to produce standard embossed Braille characters. One exemplary print system of the present invention suitable for embossing Braille characters onto paper is shown in FIG. 1.

Figure 1:
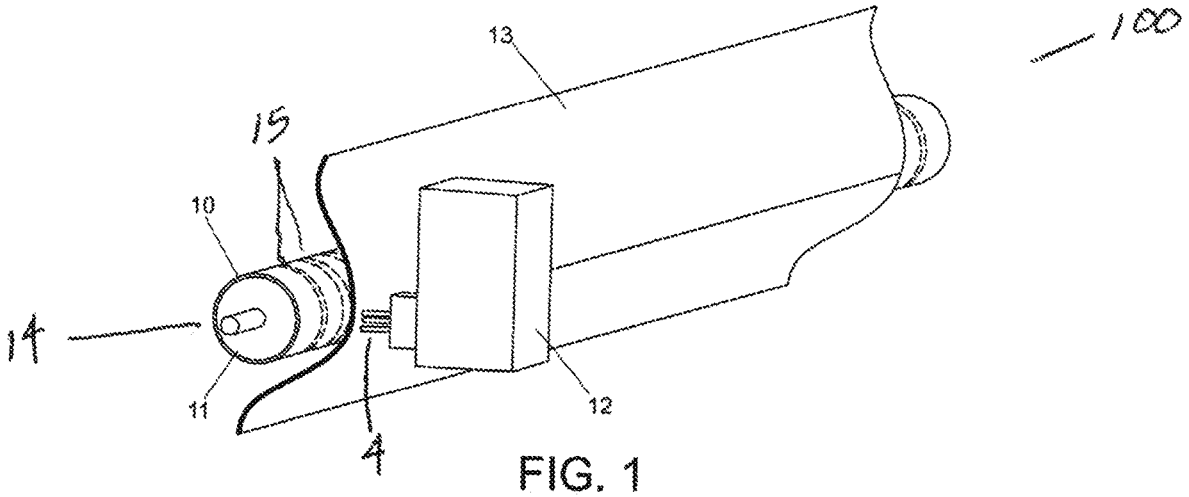
FIG. 1 shows engraving Braille characters on paper by an exemplary printing head within an exemplary print system of the present invention.

As shown in FIG. 1, exemplary print system 100 comprises an exemplary printing head 12 with exemplary pins 4 extending towards exemplary paper 13 positioned between exemplary printing head 12 and exemplary print substrate 14. In this embodiment, the exemplary print substrate 14 of the Braille printer system 100 comprises (i) a cylindrical metal sleeve 10 having a plurality of engraved divots (or holes therethrough) 15, wherein the plurality of engraved divots 15 have a size similar to standard Braille dots, and (ii) a roller 11 wherein the roller 11 is sheathed with the cylindrical metal sleeve 10. Exemplary print substrate 14 is rotated and/or moved via a printer motor (not shown), and a driver circuit (not shown).

Exemplary printing head 12 may be attached on a rod (not shown) and be moved along the rod in a manner similar to a dot matrix printer. Exemplary printing head 12 may comprise a plurality of strike pins 4, typically six strike pins 4, wherein each strike pins 4 is capable of penetrating the paper 13 and printing dots of standard Braille size on the paper 13. As further discussed below and shown, for example, in FIGS. 5-7, a plurality of low power control electromagnets 8 may be used to control movement of one or more control pins 7, a plurality of first extension pins 6 of the control pins 7, and a plurality of second extension pins 5 of the strike pins 4, wherein the first extension pins 6 and the second extension pins 5 are connected such that the second extension pin 5 moves with the movement of the first extension pin 6 and the plurality of selected first extension pins 6 moves the corresponding second extension pins 5 connected to it such that the required strike pins 4 are selected depending on the Braille character to be printed. A force electromagnet 1 may be used to move an impact substrate (e.g., metallic flap) 9 along with one or more strike pins 4 to impact paper 13 and form a given Braille character. The printing head 12 may have an aluminum body, wherein the aluminum body acts as heat sink.

Figure 2A:
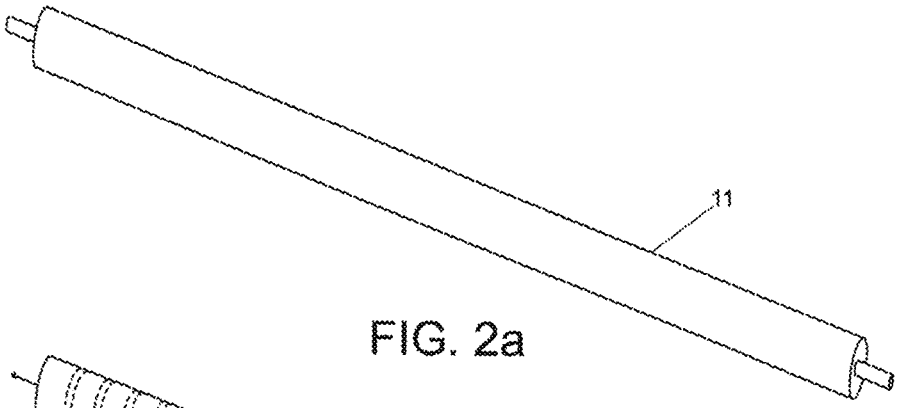
FIG. 2*a* shows an exemplary roller with decreased diameter suitable for use in the present invention.
Figure 2B:
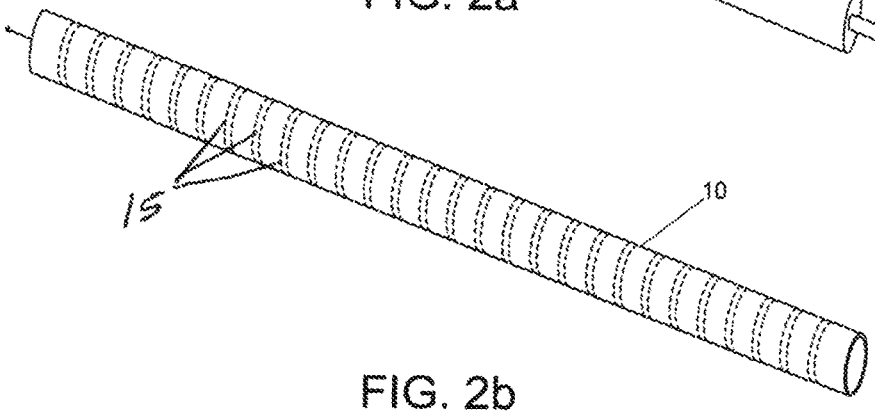
FIG. 2*b* shows a rolled metal sheet with divots suitable for use in the present invention.

As illustrated in FIG. 2*a*, a diameter of exemplary roller 11 of the Braille printer system 100 may be decreased as compared to the diameter of a dot matrix printer roller. An exemplary metal sleeve 10 having divots 15 therein may be used in combination with exemplary roller 11 as shown FIGS. 1, 2*b* and 3.

Figure 3:
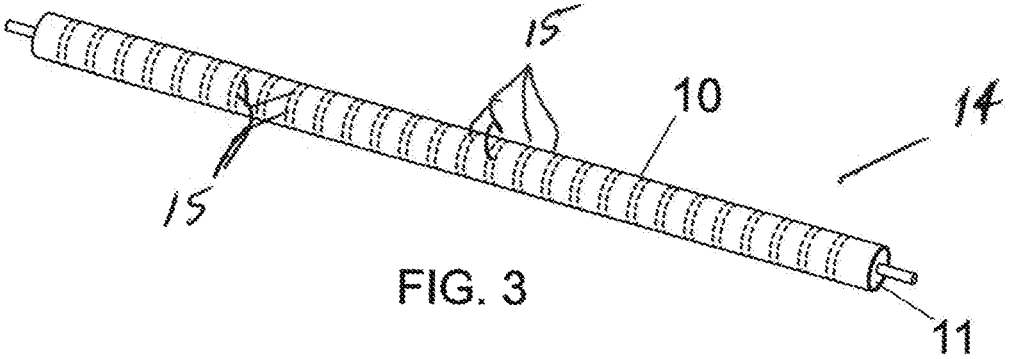
FIG. 3 shows the exemplary roller shown in FIG. 2*a* with the exemplary rolled metal sleeve with divots shown in FIG. 2*b;*

FIG. 3 illustrates exemplary roller 11 of Braille printer system 100 sheathed by metal sleeve 10 having engraved divots 15 of standard Braille dot size with standard Braille cell distance between adjacent divots 15. Thus, overall diameter of roller 11 of the Braille printer system 100 becomes substantially the same as that of a dot matrix printer due to the thickness of metal sleeve 10 sheathed on the roller 11.

The purpose of this metal sleeve 10 is to provide divots 15 in which strike pins 4 may enter, forming print dots of standard Braille size on paper 13, thus providing good sentience and readability.

In another embodiment of the present invention (not shown), the roller 11 is a hard rubber roller or roller of a dot matrix printer.

In another embodiment of the present invention (not shown), the force electromagnet 1 can be a solenoid.

In another embodiment of the present invention (not shown), the control electromagnets 8 are low power electromagnets.

In another embodiment of the present invention (not shown), the driver circuit is a microcontroller or an application processor etc.

In another embodiment of the present invention (not shown), the Braille printer (or Braille printer system 100) can have an integrated computer with a touch screen, a keyboard, a microphone, or any combination thereof as user interface, wherein the integrated computer version of the Braille printer (or Braille printer system 100) includes various features like speech to text for various languages, audio book recording and listening.

In another embodiment of the present invention, the Braille printer (or Braille printer system 100) comprises one or more motors (not shown) and printer head 12, all of which are controlled by a microcontroller that receives print command(s) from a computer or an application processor or an integrated computer. A user inputs data into the user interface and/or integrated computer, which is utilized by a computer application, such as a Braille java application, and converted into a control signal supplied to the one or more motors (not shown) and printer head 12.

As shown in FIG. 1, for producing an embossed effect, the strike pins 4 of printing head 12 penetrate the paper 13 with the help of divots 15 of standard Braille dot size engraved on the metal sleeve 10 sheathed on the roller 11. The roller 11 coupled to the printer (not shown) is taken out and the length of the printing section of the roller 11 is measured. The same length of metal sleeve 10 having certain thickness x (e.g., such that diameter of the roller 11 plus the thickness of metal sleeve 10 substantially equals the diameter of a roller for a dot matrix printer) is wrapped on (i.e., positioned over) the surface of the roller 11 manually. Also on the metal sleeve 10, divots 15 of standard Braille dot size are engraved such that standard Braille cell distance exists between adjacent divots 15 on the metal sleeve 10. After covering the roller 11 with the metal sleeve 10, the resulting print substrate 14 is fixed back into its original position in the printer (not shown). The paper 13 is placed between printing head 12 and print substrate 14. When one or more strike pins 4 from the printing head 12 strike the paper 13, the one or more strike pins 4 then move into divots 15 of the metal sleeve 10 positioned on the roller 11, thus imprinting standard Braille dots on the paper 13 with standard Braille distance between adjacent Braille dots. Also, the utilization of the plurality of strike pins 4 and design of other components within the print systems of the present invention increases the printing speed of the resulting Braille printer and Braille printer systems, such as exemplary Braille printer system 100.

Figure 4:
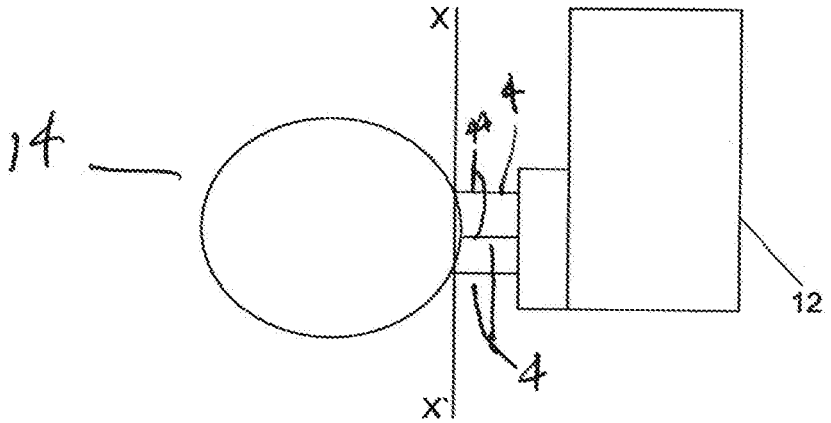
FIG. 4 shows a side view of the exemplary roller and the exemplary striking pins of the exemplary printing system shown in FIG. 1.

FIG. 4 illustrates a side view of striking pins 4, the printing head 12 and the print substrate 14. All of the strike pins 4 are parallel to each other. In this embodiment, the strike pins 4 striking the tangent of the print substrate 14 near the printing head 12 are shorter in length compared to the strike pins 4 striking other tangents of the print substrate 14. The distance of the line XX' from curved part of the print substrate 14 is equal to the difference of lengths of the strike pin 4.

Figure 5:
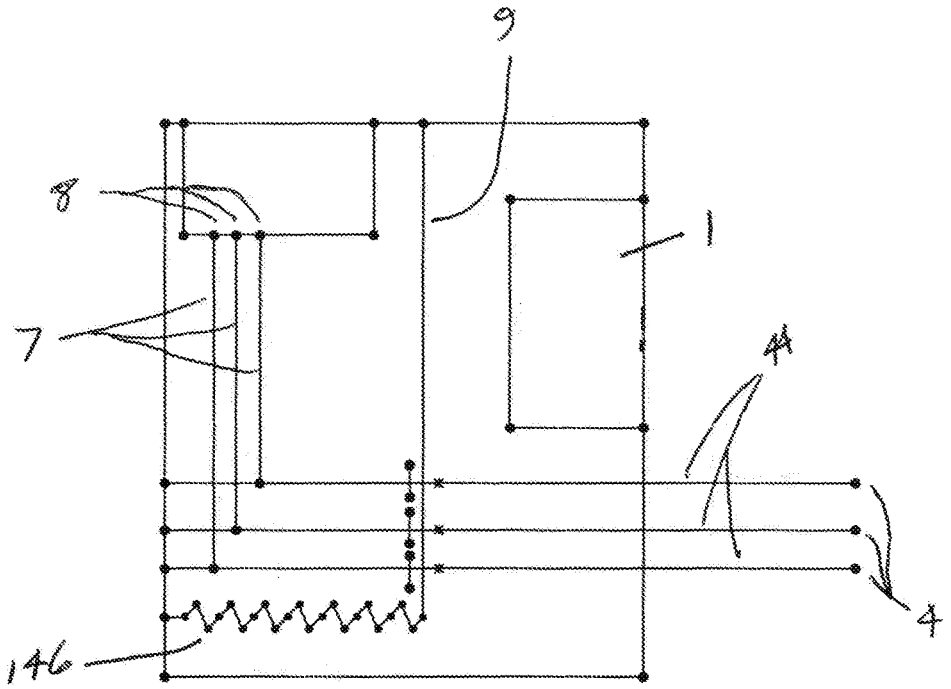
FIG. 5 shows an exemplary arrangement of three exemplary pins within internal parts of the exemplary printing head shown in FIG. 1.

As illustrated in FIG. 5, exemplary printing head 12 uses the concept of electromagnets. A command is sent to control electromagnets 8 (e.g., from a computer or microprocessor (not shown)) and the control electromagnets 8 select particular strike pins 4 within the plurality of strike pins 4 according to the Braille character to be printed. The selected strike pins 4 (also referred to herein as selected strike pins 4s) get attached to the impact substrate (e.g., metallic flap) 9, which is being attracted by the force electromagnet 1. There is a small mass (not shown) attached at a lower most point of the impact substrate (e.g., metallic flap) 9, which help the selected strike pins 4*s* gain momentum and strike with greater force. Exemplary printing head 12 may further comprise at least one impact substrate spring 146, which applies a return force on impact substrate (e.g., metallic flap) 9 so as to return impact substrate (e.g., metallic flap) 9 to its original position (i.e., non-print position) once force electromagnet 1 stops the attracting force on impact substrate (e.g., metallic flap) 9. In some embodiments, the exemplary print head 12 body comprises aluminum which acts as heat sink.

Figure 6:
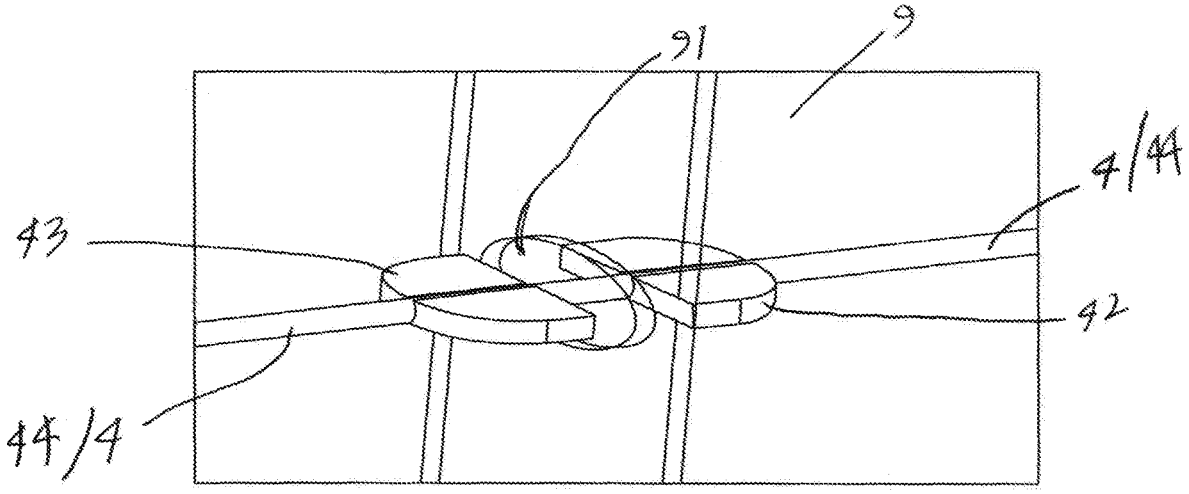
FIG. 6 shows a close-up view of an exemplary hole in an exemplary impact substrate (e.g., metallic flap) suitable for use in exemplary printing head shown in FIG. 1.

FIG. 6 illustrates a close view of a horizontal hole 91 in impact substrate (e.g., metallic flap) 9. The hole 91 allows a front strike pin extension 42 and a back strike pin extension 43, which are in a horizontal position along strike pin 4 to pass through impact substrate (e.g., metallic flap) 9 when a given strike pin 4 is not selected by the control electromagnet 8. When selected, the control electromagnet 8 rotates any selected strike pin(s) 4, which causes the position of the front extension 42 and the back extension 43 to become vertical so that the selected strike pin(s) 4 cannot pass through the hole 91. This causes the selected strike pin(s) 4 to be stuck in the hole 91 and move along impact substrate (e.g., metallic flap) 9.

Figure 7:
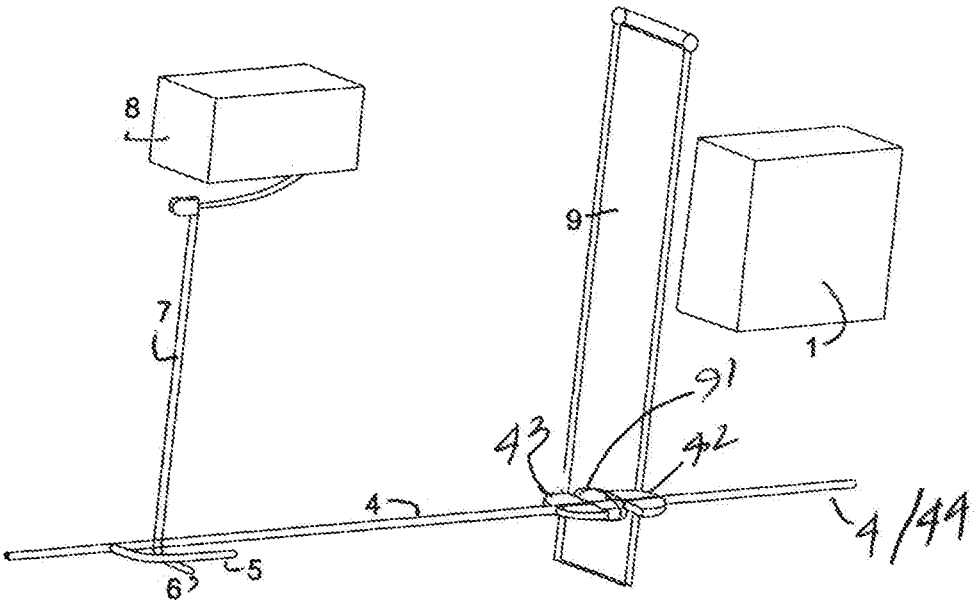
FIG. 7 shows an exemplary arrangement of exemplary internal components suitable for use in the exemplary printing head shown in FIG. 1 with an exemplary pin positioned to extend and move through the exemplary hole shown in FIG. 6.
Figure 8:
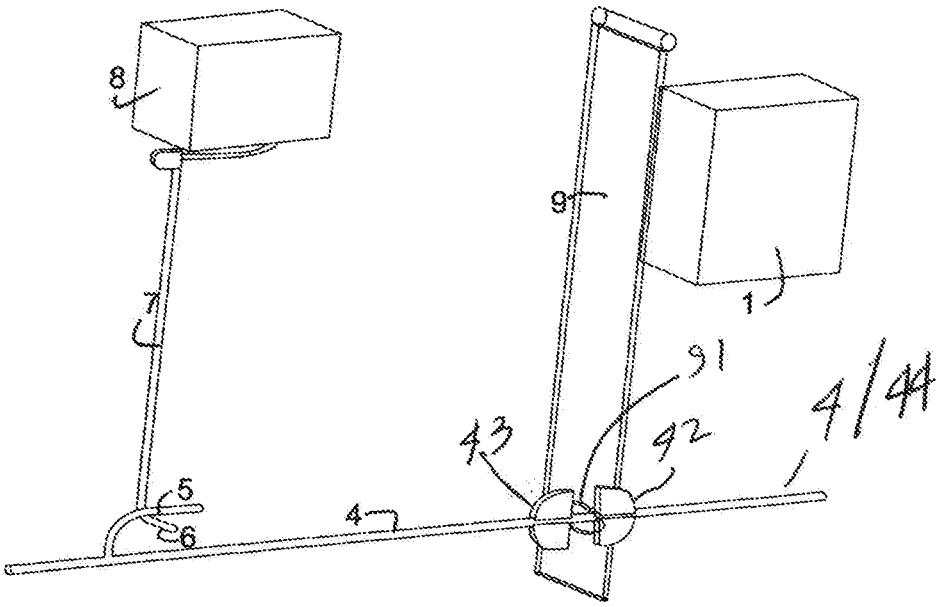
FIG. 8 shows the arrangement of FIG. 7 except the exemplary pin is engaged with outer edges of the exemplary hole shown in FIG. 6 so as to move when impact substrate (e.g., metallic flap) moves to emboss a paper substrate.

As illustrated in FIG. 7 and FIG. 8, the front extension 42 and the back extension 43 of a given strike pin(s) 4 helps engage with impact substrate (e.g., metallic flap) 9 via an outer edge(s) of hole 91 or avoid impact substrate (e.g., metallic flap) 9 via hole 91.

FIGS. 7 and 8 illustrate the working of the control electromagnet 8 for a single strike pin 4. When a control signal is sent to the control electromagnet 8, the control electromagnet 8 pulls control pin 7 upward and hence the first extension pin 6 attached to control pin 7 is also moved upward which in turn pulls the second extension pin 5 of the selected control pin 7 vertically. By this process the selected strike pin 4 rotates and the front extension 42 in front view of the impact substrate (e.g., metallic flap) 9 and the back extension 43 in back of the impact substrate (e.g., metallic flap) 9 changes its position as shown in FIG. 8. Now when the force electromagnet 1 attracts the impact substrate (e.g., metallic flap) 9, the impact substrate (e.g., metallic flap) 9 takes the selected strike pin 4 forward which is stuck in hole 91 along with the impact substrate (e.g., metallic flap) 9 and causes the selected strike pin 4 to strike the paper 13 with a desired amount of printing/engraving/embossing force.

Figure 9:
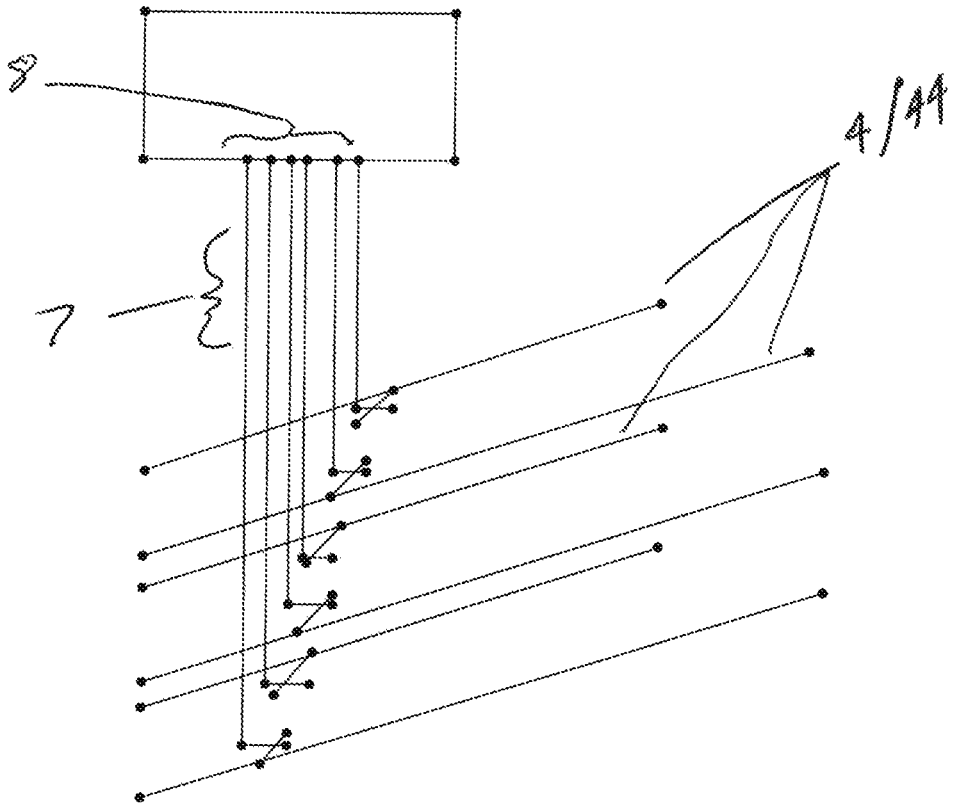
FIG. 9 shows an exemplary printing head with 6 pins, wherein each pin independently moves through and/or engages with an impact substrate (e.g., metallic flap) as shown in FIGS. 7-8.

In another embodiment of the present invention, as illustrated in FIG. 9, the printing head 12 comprises six small control electromagnets 8, six control pins 7 and six strike pins 4. More number of strike pins 4 results in better printing speed of Braille characters.

Heat is being dissipated when electromagnet 1 is used frequently. This heat can lead to burning of a coil within electromagnet 1 and eventually electromagnet 1 stops working.

$$\text{Heat}=i^2*r*t$$

$$\text{Heat}\propto i^2,\ \text{Heat}\propto r$$

The above equation shows that it is better to decrease current rather than resistance to reduce the heat dissipation. So, a minimum possible current is desired to minimize heat overload of electromagnet 1.

Figure 10:
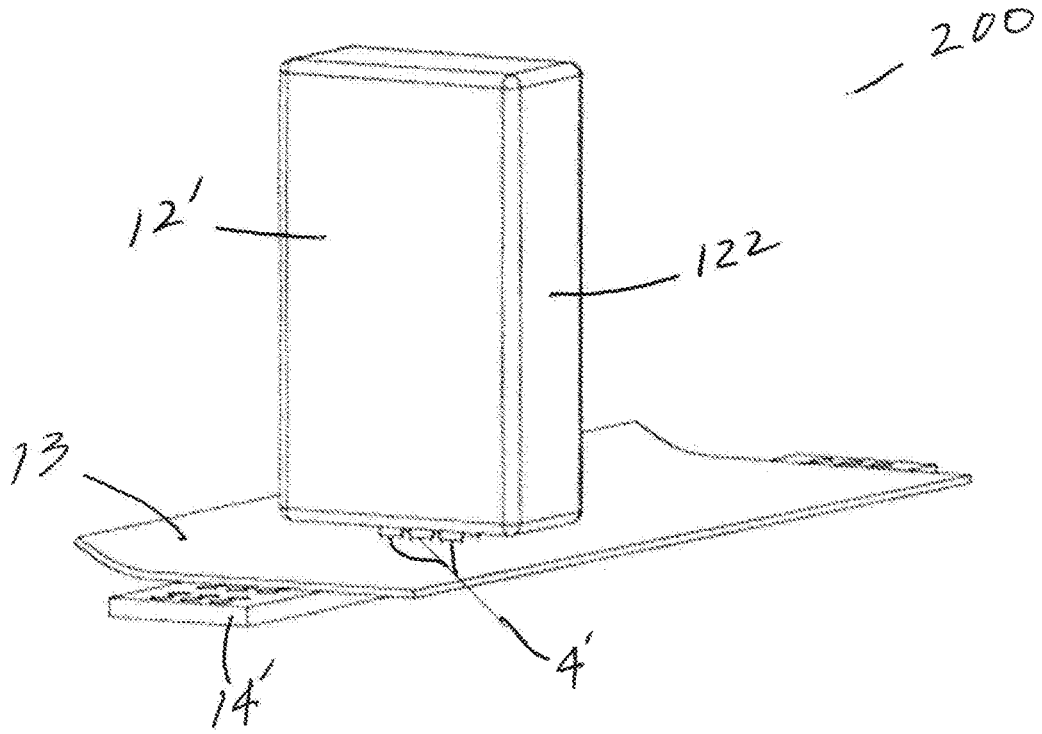
FIG. 10 shows engraving Braille characters on paper by another exemplary printing head of the present invention.
Figure 11:
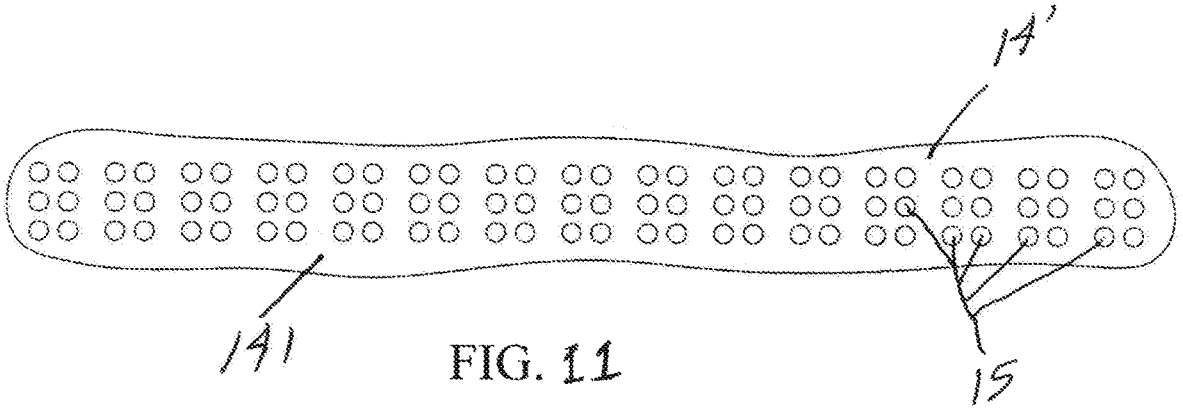
FIG. 11 depicts and exemplary print substrate for use with the exemplary printing head shown in FIG. 10.

Another exemplary print system of the present invention suitable for embossing Braille characters onto paper is shown in FIG. 10. As shown in FIG. 10, exemplary print system 200 comprises an exemplary printing head 12' with exemplary pins 4' extending towards exemplary paper 13 positioned between exemplary printing head 12' and exemplary print substrate 14'. In this embodiment, the exemplary print substrate 14' comprises an upper surface 141 having a plurality of engraved divots (or holes) 15 therein, wherein the plurality of engraved divots 15 have a size similar to standard Braille dots. Like exemplary print system 100 discussed above, exemplary print system 200 may comprise multiple components to assist with the printing/engraving/embossing of Braille characters onto paper 13 (e.g., one or more printer motors (not shown), a driver circuit (not shown), a rod (not shown) for holding printing head 12' in a position relative to paper 13 and print substrate 14', other hardware components commonly found in printers such as dot matrix printers, software for processing user input and sending control signals to hardware components such as control components 8, and microprocessors and/or computers and/or other user interface items as discussed above).

Figure 12:
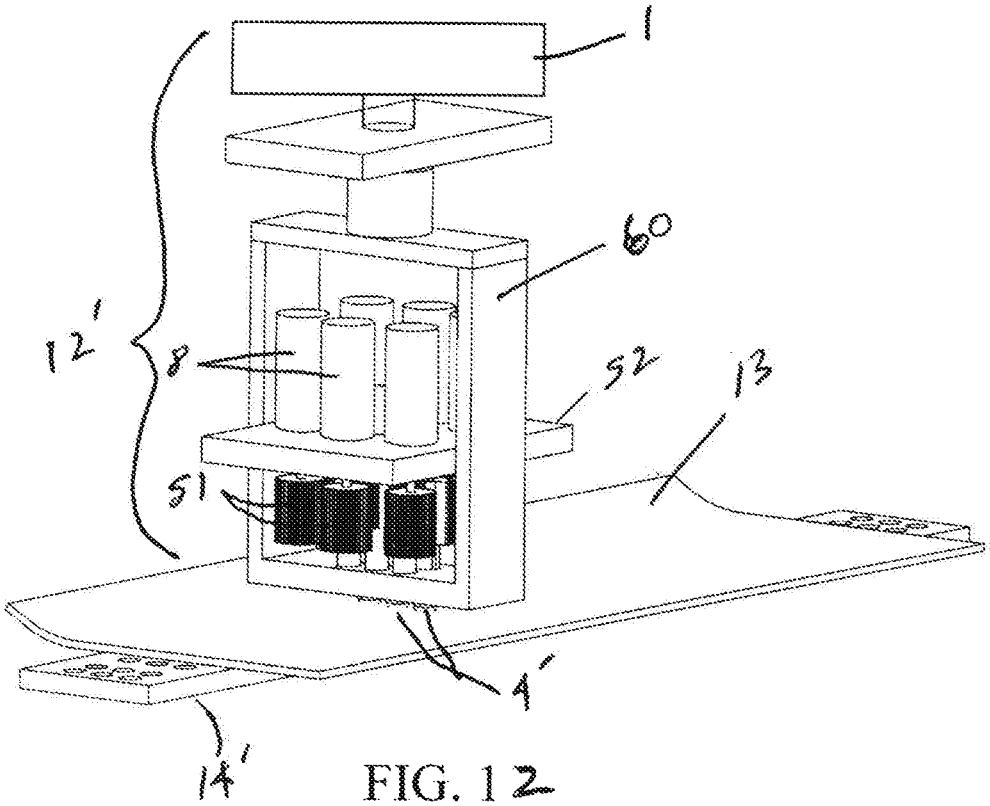
FIG. 12 depicts exemplary internal components suitable for use in the exemplary printing head shown in FIG. 10.

In addition, exemplary print system 200 may comprise an exemplary printing head 12' comprising the internal components as discussed below and shown in FIGS. 12-19. As shown in FIG. 12, exemplary printing head 12' comprises a plurality of strike pins 4' wherein the strike pins 4' penetrate paper 13 and print dots of standard Braille size on the paper 13; a plurality of low power control components 8 which can be motors or rotary solenoids, wherein the control components 8 are controlled by an electronic control signal (i.e., from a wired or wireless signal-generating device such as a computer or microprocessor); a plurality of component gears 51 wherein the angular movement of component gears 51 are controlled by the control components 8; a pin plate 52 wherein the plate 52 contain first holes 53 to hold control components 8 in place and second holes 54 to support a vertical position and portion of strike pins 4'. A plurality of pin gears 41 on strike pins 4' engage with component gears 51 such that the pin gears 41 rotate with the angular movement of the component gears 51 and the plurality of pin gears 41 cause rotation of the corresponding selected pins 4'. In this embodiment, each strike pin 4' also comprises a first key 43' and a second key 42'. As discussed further below, rotation of selected pins 4' causes one or more selected strike pins 4' to become attached to frame 60 with help of, a force component 1, which can be a solenoid or an actuator or an electromagnet, so that the one or more selected strike pins 4' move with frame 60 towards or away from paper 13. Exemplary frame 60 comprises an impact substrate 9' having a plurality of engraved key holes 91' therein, wherein the plurality of engraved key holes 91' enable unselected pins 4' to move freely therethrough, while engaging with selected strike pins 4' so as to move the selected strike pins 4' along with frame 60 when frame 60 (impact substrate 9') is moved (e.g., pushed and/or pulled) by the force component 1 towards or away from paper 13. Further description of the printing operation of this embodiment is provided below with reference to FIGS. 12-19.

FIG. 12 illustrates exemplary printing head 12' by providing a view of internal parts of exemplary printing head 12' and its use to print on paper 13 with the help of print substrate 14'. In operation, an electronic command is sent to control component(s) 8 which are held by fixed pin plate 52, and control component(s) 8 select one or more strike pins 4' depending on the Braille character to be printed. The selected one or more strike pins 4' become attached to the movable frame 60, which is being moved by the force component 1.

Figure 13:
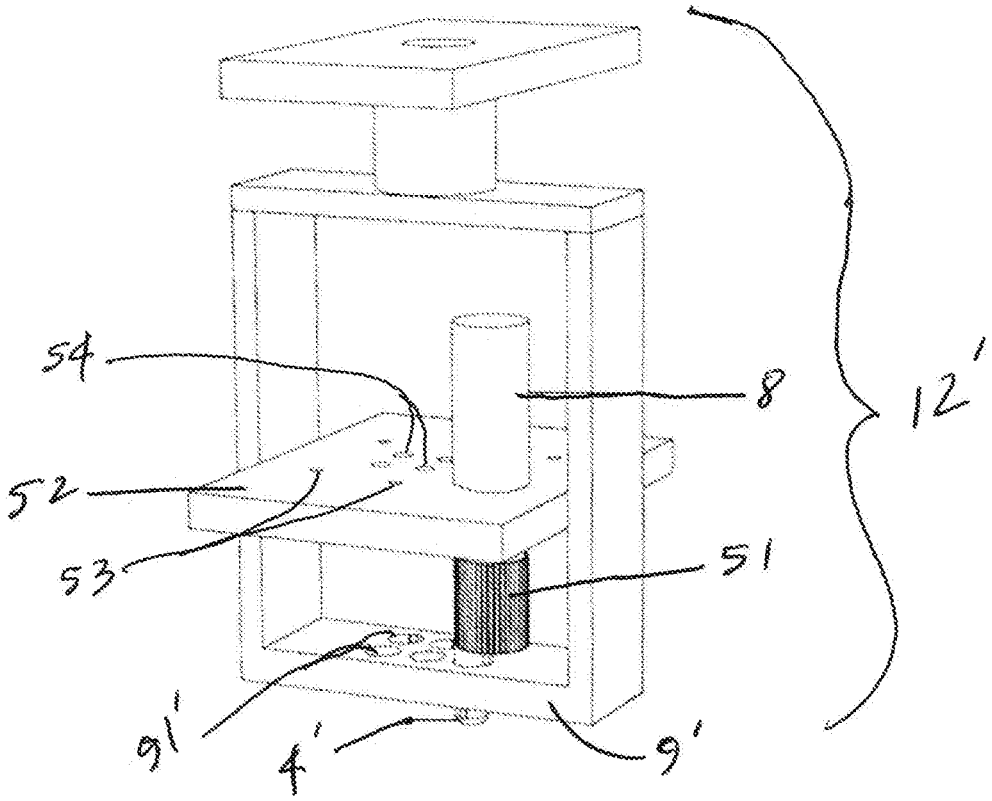
FIG. 13 depicts a closer view of one of the exemplary pin assemblies within the exemplary internal components shown in FIG. 12.

FIG. 13 illustrates a single strike pin 4' arrangement in exemplary printer head 12', which contains a movable frame 60, fixed pin plate 52, a control component 8 and a strike pin 4'. The control component 8 is held by fixed plate 52. The whole frame 60 is moved by force component 1 along with one or more selected pins 4' in order to print a Braille character.

Figure 14:
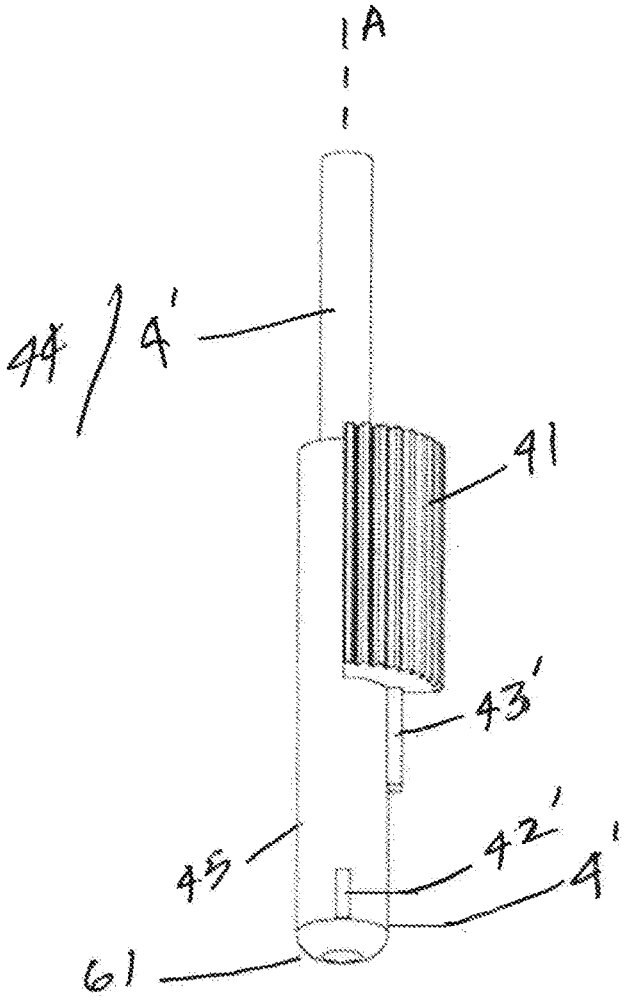
FIG. 14 depicts a closer view of one of the exemplary pins within the exemplary internal components shown in FIG. 12.

FIG. 14 illustrates a close-up view of exemplary strike pin 4'. Exemplary strike pin 4' contains pin gears 41, first key 43' and second key 42'. Pin gear 41 rotates the strike pin 4' to engage with or unengaged with the movable frame 60. Second key 42' helps a given strike pin 4' to become engaged with or unengaged from movable frame 60. First key 43' brings the given pin(s) 4' back to its original position (along with impact substrate 9') after a braille character is printed.

Figure 15:
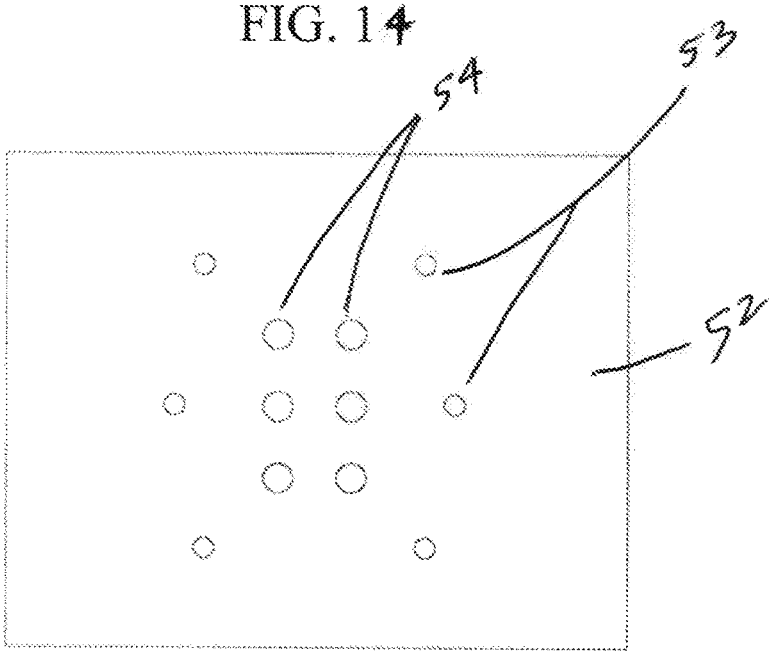
FIG. 15 depicts a top view of the exemplary pin plate within the exemplary internal components shown in FIG. 12.
Figure 16:
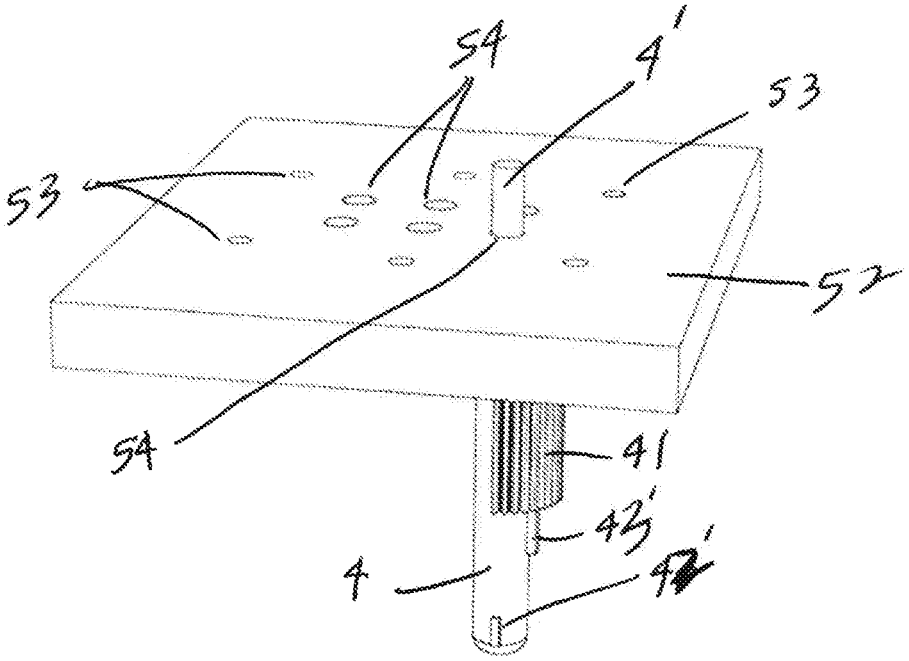
FIG. 16 depicts a closer view of an exemplary pin positioned through the exemplary pin plate within the exemplary internal components shown in FIG. 12.

FIG. 15 illustrates exemplary pin plate 52. Exemplary pin plate 52 contains first through holes 53 and second through holes 54. Second through holes 54 hold strike pins 4' in a vertical position that is at a 90 degree angle to pin plate 52 as shown in FIG. 16. First through holes 53 hold control components 8 in position as shown in FIG. 14. Pin plate 52 can be fixed to an outer body 122 of exemplary printing head 12' (i.e., along opposite interior sides outer body 122) so that exemplary pin plate 52 is stationary while the remaining portions of frame 60) slides within outer body 122. In other embodiments, exemplary pin plate 52 is not attached to outer body 122, and slides within outer body 122 along with the remaining components of frame 60.

Figure 17:
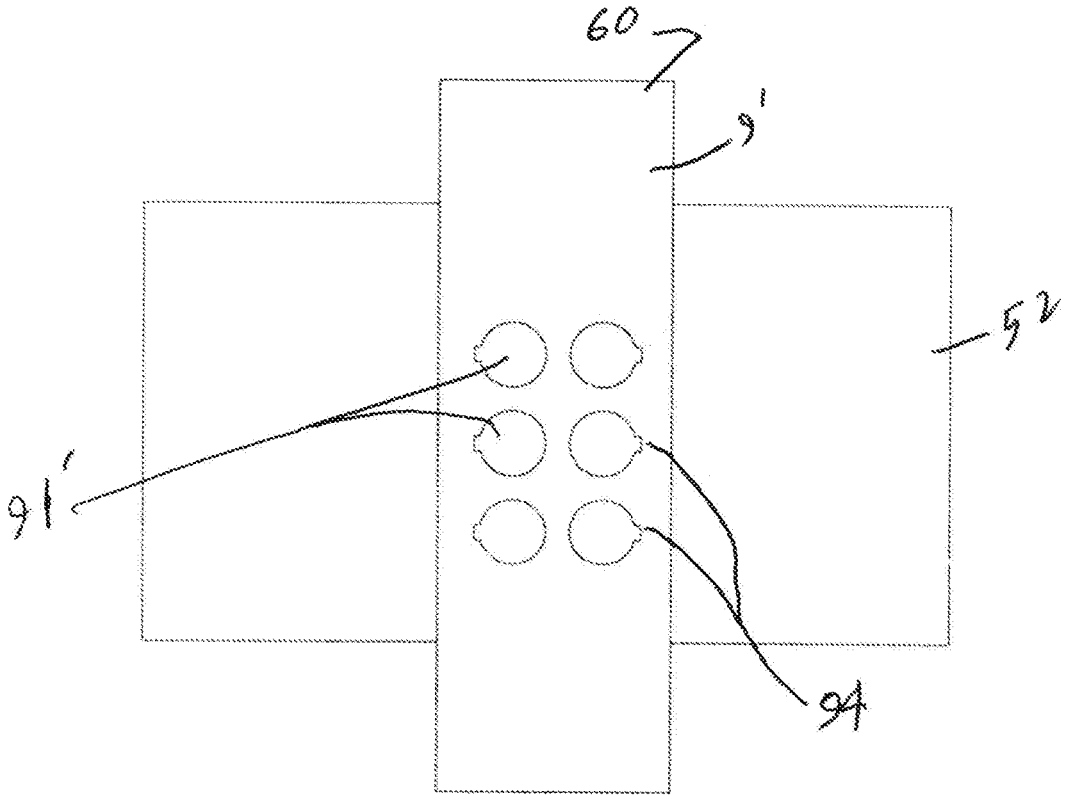
FIG. 17 depicts a bottom view of the exemplary impact plate within the exemplary internal components shown in FIG. 12.

FIG. 17 illustrates a bottom view of impact substrate 9' of frame 60. As shown in FIG. 17, impact substrate 9' of frame 60 comprises a plurality of engraved key holes 91'. In this embodiment, at least a portion of each strike pin 4' is always present within key hole 91' such that the first key 43' is on one side of impact substrate 9' of frame 60 (e.g., an upper side) and second key 42' is on an opposite side of impact substrate 9' of frame 60 (e.g., a lower side). The unengaged or unselected position of pin 4' is when the second key 42' matches (i.e., is aligned with) notch 94 within key hole 91', and in this position, the strike pin 4' does not form any portion of a Braille character when impact substrate 9' of frame 60 contacts paper 13 (i.e., first key 43' of strike pin 4' simply slides within notch 94 key hole 91' as impact substrate 9' moved towards and away from print paper 13). The engaged or selected position of a given strike pin 4' is when second key 42' is in an offset position (i.e., is not aligned with) relative to notch 94 within key hole 91', and in this position, the strike pin 4' does form a portion of a Braille character when impact substrate 9' of frame 60 contacts paper 13.

Figure 18:
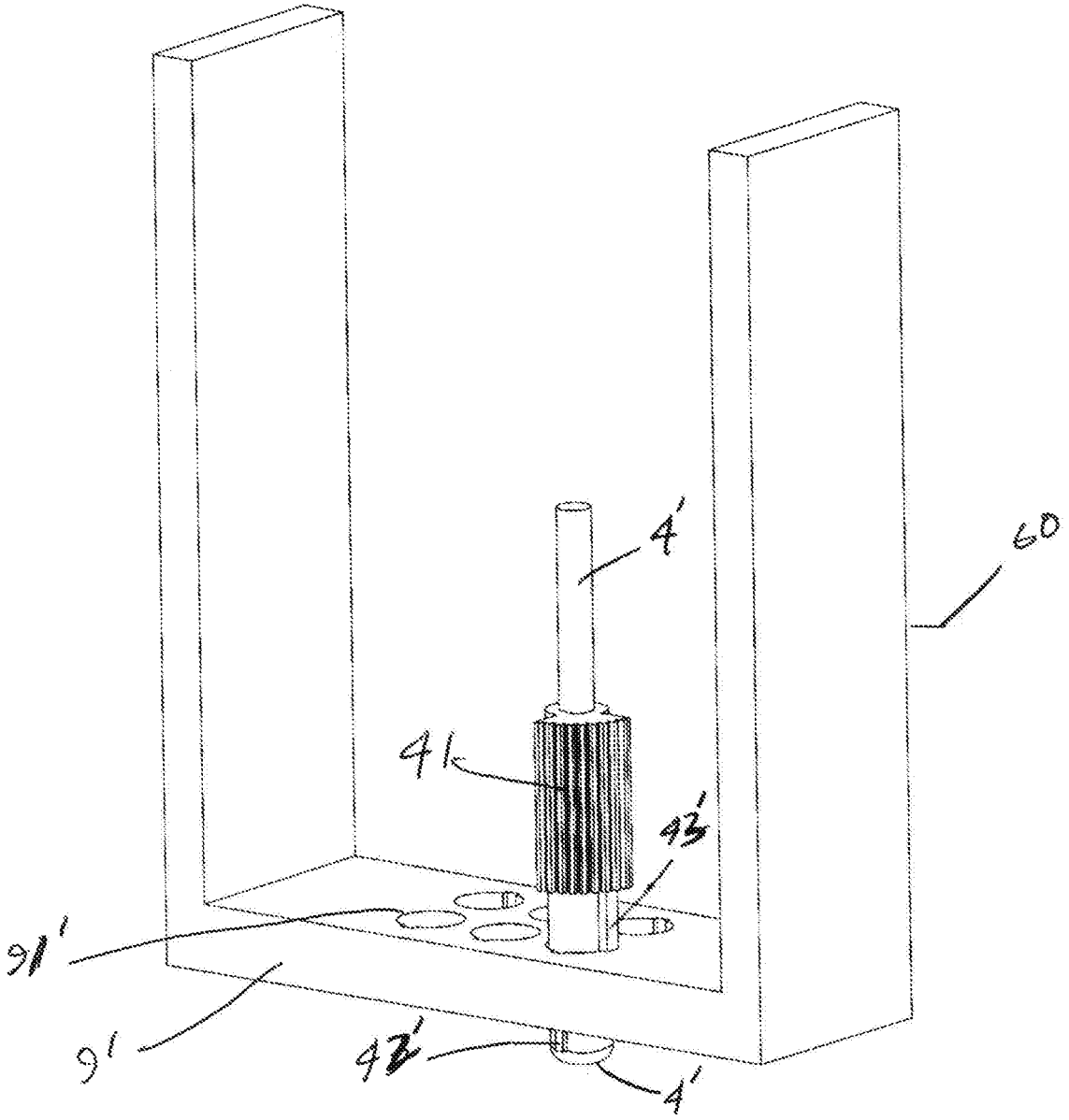
FIG. 18 depicts a closer view of an exemplary pin positioned through the exemplary impact plate within the exemplary internal components shown in FIG.12.
Figure 19:
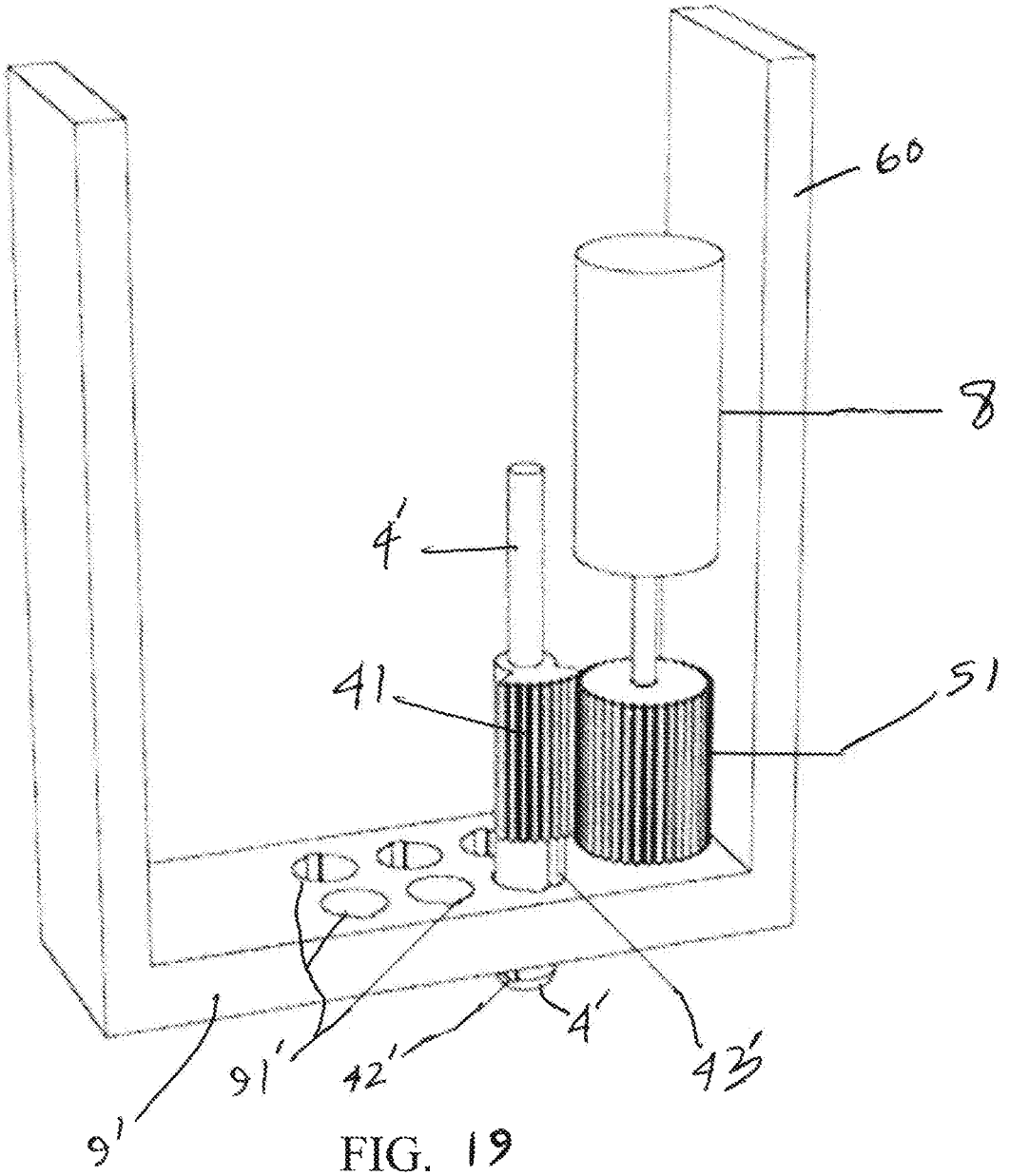
FIG. 19 depicts a closer view of (i) an exemplary pin positioned through the exemplary impact plate and (ii) an exemplary gear assembly within the exemplary internal components shown in FIG. 12.

FIG. 19 illustrates the working together of a control component 8 and a strike pin 4' along with frame 60. When Braille printing of a given strike pin 4' is not required, the strike pin 4' is in an unengaged position (as shown in FIG. 18). When Braille printing of a given strike pin 4' is required, control component 8 rotates the component gear 51, which in turn rotates pin gear 41, which finally moves the position of second key 42' to an offset position, not aligned with key hole 91'. When force component 1 applies a strike force onto frame 60 comprising engaged strike pin 4', impact substrate 9' of frame 60 produces Braille print. After printing a Braille character, the control component 8 rotates in an opposite direction so as to align second key 42' of a given strike key 4' with notch 94 of hole 91' within impact substrate 9' of frame 60 so as to move the strike pin 4' back into an unengaged position.

Figure 20:
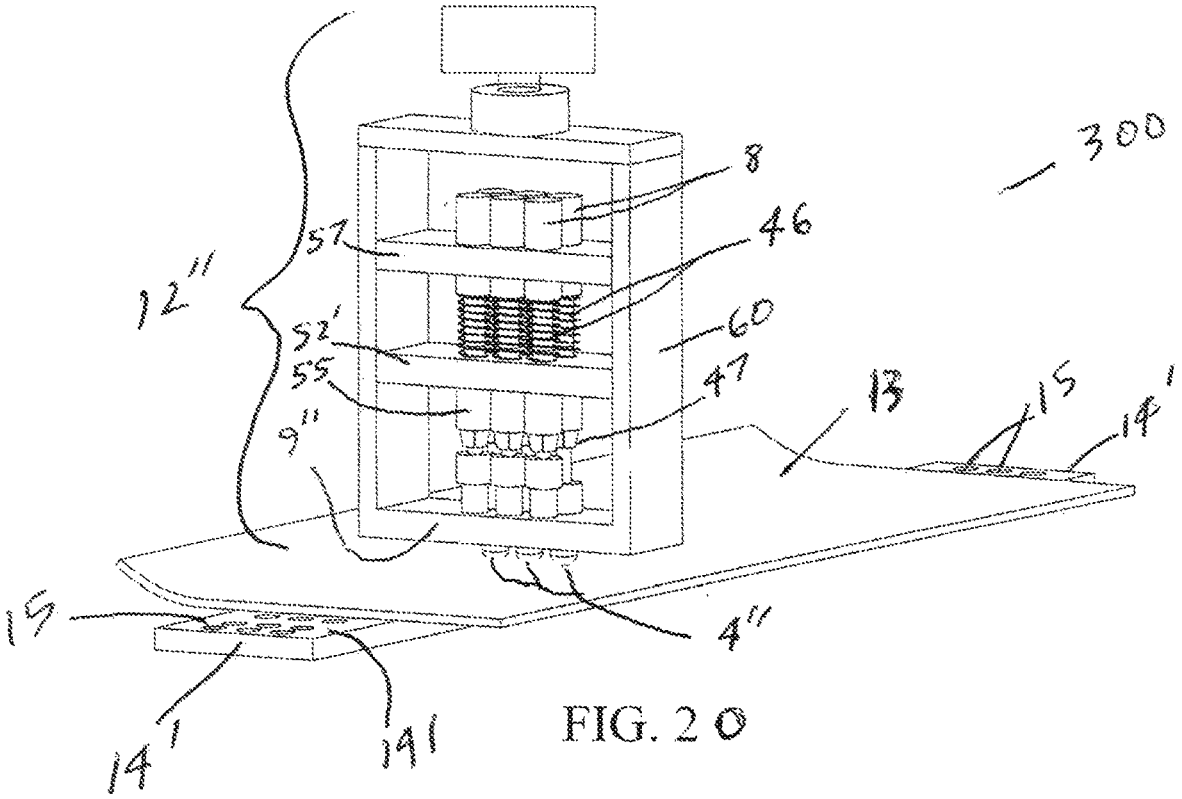
FIG. 20 depicts exemplary internal components suitable for use in the exemplary printing head shown in FIG. 10.

Another exemplary print system of the present invention suitable for embossing Braille characters onto paper is shown in FIG. 20. As shown in FIG. 20, exemplary print system 300 comprises an exemplary printing head 12" with exemplary pins 4" extending towards exemplary paper 13 positioned between exemplary printing head 12" and exemplary print substrate 14'. In this embodiment, like exemplary print system 200, the exemplary print substrate 14' comprises an upper surface 141 having a plurality engraved divots (or holes) 15 therein, wherein the plurality of engraved divots 15 have a size similar to standard Braille dots. Like exemplary print systems 100 and 200 discussed above, exemplary print system 300 may comprise multiple components to assist with the printing/engraving/embossing of Braille characters onto paper 13 (e.g., one or more printer motors (not shown), a driver circuit (not shown), a rod (not shown) for holding printing head 12" in a position relative to paper 13 and print substrate 14', other hardware components commonly found in printers such as dot matrix printers, software for processing user input and sending control signals to hardware components such as control components 8, and microprocessors and/or computers and/or other user interface items as discussed above).

Figure 21A:
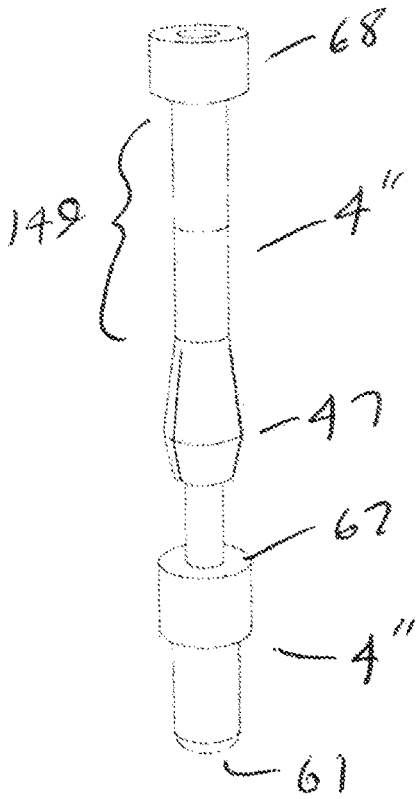
FIG. 21*a* depicts a closer view of an exemplary pin suitable for use in the exemplary internal components shown in FIG. 20 with an exemplary pin holding flaps in a closed position.

In addition, exemplary print system 300 may comprise an exemplary printing head 12" comprising the internal components as discussed below and shown in FIGS. 20-27*b*. As shown in FIGS. 21*a*-28*b*, exemplary printing head 12" comprises a plurality of control components 8 for moving stroke pins 4" up or down; a plurality of pin springs 46 and pin holding flaps 47 having a cylindrically hollow cavity 48 therein, wherein movement of pin springs 46 and opening and closing of pin holding flaps 47 are controlled by control components 8 and movement of pin springs 46 and pin holding flaps 47 select or unselect the one or more strike pins 4" to print a given Braille character; a pin plate 52' wherein the pin plate 52' contain a plurality of cylindrical hollow structures 55 positioned along a lower surface 54 of pin plate 52' below a plurality of Braille cell size holes 56 in pin plate 52' with cylindrical hollow structures 55 holding pin holding flaps 47 in a closed configuration as shown in FIG. 21*a* (i.e., when at least a portion of pin holding flap 47 of a given strike pin 4" is positioned within a given cylindrical hollow structure 55); a component plate 57, wherein the component plate 57 contains a plurality of component plate holes 58 to hold control components 8 in place; a force component 1, which can be solenoid or actuator or electromagnet; and a frame 60, wherein an impact substrate 9" of frame 60 has a plurality of engraved through holes 91" therein, wherein the plurality of engraved through holes 91" have a size similar to standard Braille dots, wherein the plurality of through holes 91" allows movement of unselected pins 4" through it. Further description of the printing operation of this embodiment is provided below with reference to FIGS. 20-27*b*.

As shown in FIG. 20, for producing an embossed effect, strike pins 4" of printing head 12" penetrate the paper 13 with the help of divots (or holes) 15 of standard Braille dot size engraved within the surface 141 of print substrate 14'. Also, on 141 of print substrate 14', divots 15 of standard Braille dot size are engraved such that standard Braille cell distance exists between adjacent divots 15 on surface 141. The paper 13 is placed between printing head 12" and surface 141. When one or more strike pins 4" from the printing head 12" strike paper 13, the one or more strike pins 4" then move into divots 15 of surface 141, thus imprinting standard Braille dots on paper 13 with standard Braille distances between adjacent Braille dots. Also, utilization of simultaneous strikes with a plurality of strike pins 4" increases the printing speed of the Braille print system 300.

FIG. 20 illustrates exemplary printing head 12" with a view of internal parts of exemplary printing head 12" and the step of printing on paper 13 with the help of print substrate 14'. Similar to the discussion above, an electronic command is sent to one or more of control components 8, which are held by fixed component plate 57 and the one or more of control components 8 select one or more strike pins 4" depending on the Braille character to be print. Then, whole frame 60 is moved by the force component 1, moving the selected strike pins 4" therewith, printing a Braille character on paper 13.

Figure 21B:
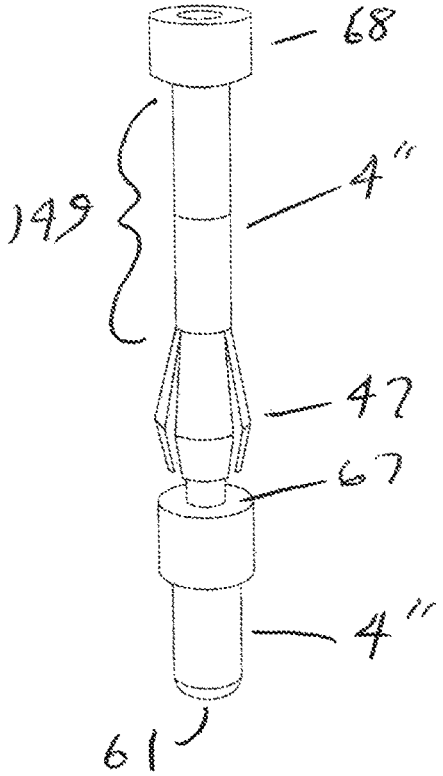
FIG. 21*b* depicts a closer view of the exemplary pin shown in FIG. 21*a* with the exemplary pin holding flaps in an open position.

FIGS. 21*a*-21*b* illustrates an exemplary strike pin 4" and the pin holding flap 47 thereon. Exemplary strike pin 4" has a cylindrically hollow cavity 48 therein and a pin stem portion 49 (see, FIG. 27*b*). The pin stem portion 49 is always inserted within cylindrically hollow cavity 48 of pin holding flap 47. The pin holding flap 47 can unselect or select a given strike pin 4" by opening (as shown in FIG. 21*b*) and closing the flap 47 (as shown in FIG. 21*a*). Strike pin portion 67 of strike pin 4" doesn't allow a portion of strike pin 4" to move inside the cylindrically hollow cavity 48 of pin holding flap 47 as shown in FIG. 20.

Figure 22:
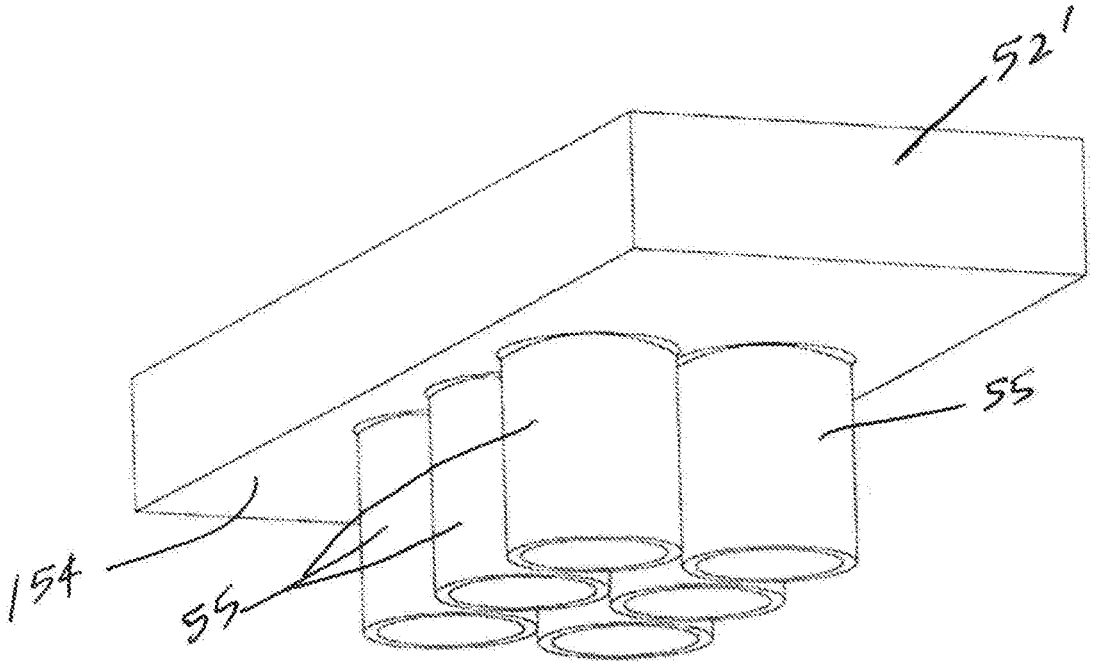
FIG. 22 depicts a perspective view of another exemplary pin plate suitable for use within the exemplary internal components shown in FIG. 20.
Figure 23:
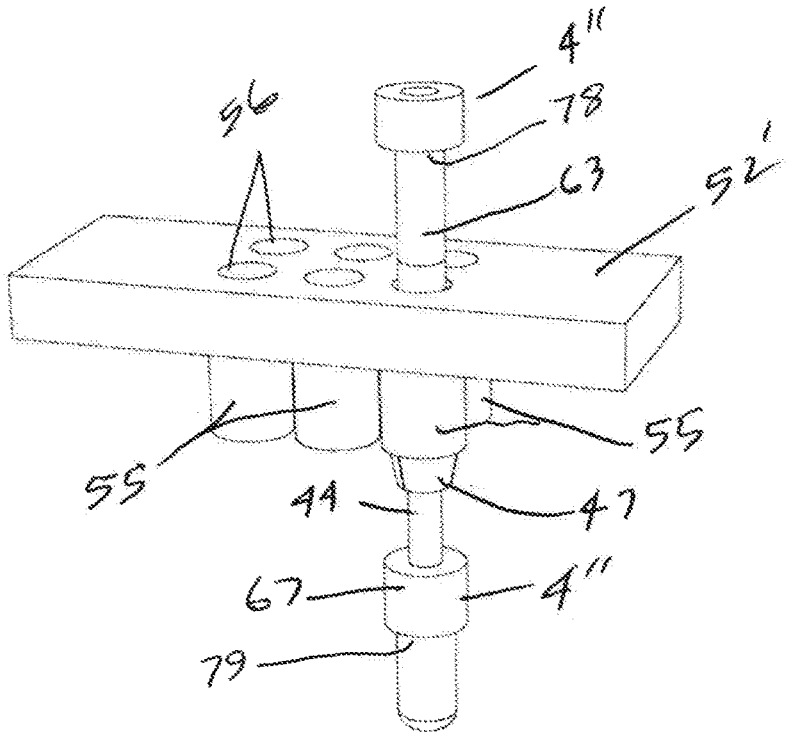
FIG. 23 depicts a closer view of (i) an exemplary pin positioned through the exemplary pin plate shown in FIG.22.

FIG. 22 illustrates the pin plate 52' having a plurality of cylindrical hollow structures 55 that close pin holding flaps 47 of all strike pins 4" when springs 46 are tight (i.e., not stretched) and not pressed as shown in FIG. 20.

Figure 24:
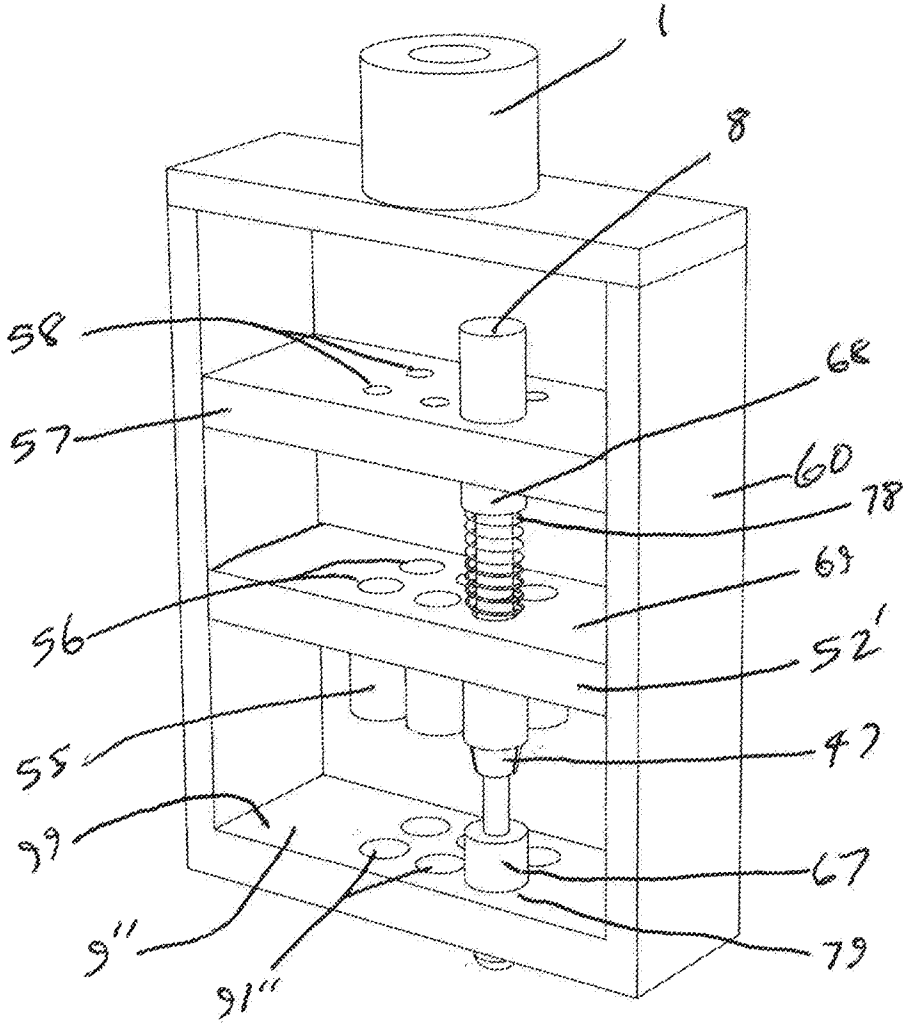
FIG. 24 depicts a perspective view one exemplary pin positioned within the exemplary internal components shown in FIG. 20.

FIG. 24 illustrates one strike pin 4" within exemplary Braille print system 300 and its working. Component plate 57 is attached to frame 60 and holds the control component(s) 8 in place. Pin plate 52' contains a plurality of through holes 56 having a diameter greater than cylindrical hollow cavity portion 149 of strike pin 4". Spring 46 is held tight by enlarged end 68 of strike pin 4" and an upper surface 69 of pin plate 52'. An expandable portion of pin holding flap 47 resides inside the cylindrically hollow structures 55. Stem portion 49 of strike pin 4" is inserted into cylindrical hollow cavity 49 through pin holding flap 47 and strike pin 4" is also passing through the hole 91" of impact substrate 9" of frame 60.

Initially, the spring 46 is tight enough to keep the pin holding flap 47 closed, and because of this, strike pin 4" is held tight and this strike pin 4" is a selected strike pin 4". At this position, when force component 1 applies a push force onto frame 60, the selected pin 4" will provide Braille printing of at least a portion of a Braille character. In -order to unselect a given strike pin 4", control component 8 applies a push force onto enlarged end strike pin portion 68 and cylindrically hollow cavity portion 149 to compress the spring 46, which allows the cylindrically hollow cavity 149 to move inside the cylindrical hollow structures 55, which in-turn opens the pin holding flaps 47 (as shown in FIG. 21*b*) and releases the strike pin 4". These unselected strike pin(s) 4" move inside the cylindrically hollow cavity 49 when other selected strike pins 4" are printing.

Figure 25:
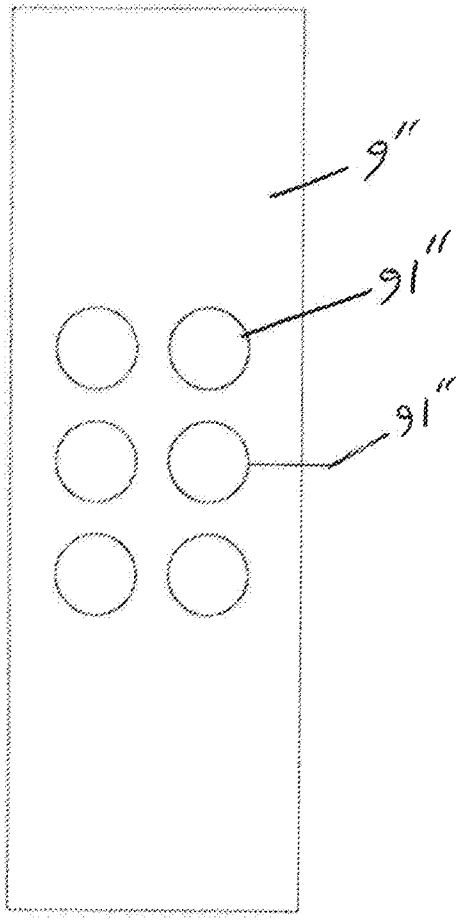
FIG. 25 depicts a top view of the exemplary pin plate within the exemplary internal components shown in FIG. 20.

FIG. 25 illustrates a bottom view of impact substrate 9", which forms a lower portion of frame 60. As shown in FIG. 25, impact substrate 9" has a plurality of engraved through holes 91" having a diameter greater than a diameter of a portion of strike pin 4" extending through hole 91". Through holes 91" allow easy movement of strike pins 4" therethrough.

FIG. 27*a* depicts a side view of exemplary printing head 12" shown in FIG. 20. FIG. 27*b* depicts a cross-sectional view of the above-described internal components of exemplary printing head 12" as viewed along line 27*b*-27*b* shown in FIG. 27*a*.

Additional Embodiments

Braille Printer Components

1. A Braille printing head 12/12'/12" capable of forming Braille characters on a paper substrate 13, said Braille printing head 12/12'/12" comprising: a plurality of strike pins 4/4'/4"; an impact substrate 9/9'/9" having at least one strike pin hole 91/91'/91" therein for each strike pin 4/4'/4" within said plurality of strike pins 4/4'/4" to extend through; and a force-providing component 1, said force-providing component 1 being positioned to apply a force onto said impact substrate 9/9'/9" so as to move (i) said impact substrate 9/9'/9" and (ii) one or more selected strike pins 4*s*/4*s'*/4*s"* within said plurality of strike pins 4/4'/4" that are engaged with or connected to said impact substrate 9/9'/9" towards a paper substrate 13 to impact the paper substrate 13 and form a Braille character. As used herein, the phrase "connected to" means the plurality of strike pins 4/4'/4" are directly connected (i.e., are in direct contact to impact substrate 9/9'/9") or indirectly connected (i.e., are connected to the impact substrate 9/9'/9" via one or more additional components) to impact substrate 9/9'/9" so as to move with impact substrate 9/9'/9" when impact substrate 9/9'/9" moves towards or away from print substrate 13 during a process of printing/embossing/engraving/forming Braille dots on print substrate 13.

2. A Braille printing head 12/12'/12" capable of forming Braille characters on a paper substrate 13, said Braille printing head 12/12'/12" comprising: a plurality of strike pins 4/4'/4", wherein each strike pin 4/4'/4" within said plurality of strike pins 4/4'/4" comprises a strike pin rod 44 having a circular cross-sectional area and an outer rod surface 48, a strike pin impact end 61 for forming a dot of a Braille character, and at least one strike pin extension 42/43/42'/43' extending outward from said outer rod surface 61, said at least one strike pin extension 42/43/42'/43' being configured to be engagable with an impact substrate 9/9'/9" of said Braille printing head 12/12'/12" and be movable with the impact substrate 9/9'/9" towards a paper substrate to impact the paper substrate and form a Braille character.

3. The Braille printing head 12/12'/12" of embodiment 2, wherein each strike pin 4/4'/4" within said plurality of strike pins 4/4'/4" comprises two strike pin extensions 42/43/42'/43' extending outward from said outer rod surface, said two strike pin extensions 42/43/42'/43' being spaced apart from one another along said strike pin rod so as to be positionable on opposite sides of the impact substrate 9/9'/9" upon impact with the paper substrate.

4. The Braille printing head 12/12'/12" of embodiment 2 or 3, wherein each strike pin 4/4'/4" within said plurality of strike pins 4/4'/4" further comprises at least one strike pin component 41 along said strike pin rod 44 that enables said strike pin 4/4' to be rotated about a dissecting axis A extending through said strike pin 4/4'. See, for example, dissecting axis A shown in FIG. 14.

5. A Braille printing head 12/12'/12" capable of forming Braille characters on a paper substrate 13, said Braille printing head comprising: a plurality of strike pins 4/4'/4", wherein each strike pin 4/4'/4" within said plurality of strike pins 4/4'/4" comprises a strike pin rod 44 having a circular cross-sectional area and an outer rod surface 45, a strike pin impact end 61 for forming a dot of a Braille character, and at least one strike pin component 5/41 along said strike pin rod 44 that enables said strike pin 4/4'/4" to be rotated about a dissecting axis A extending through said strike pin 4/4'/4". See, for example, FIG. 14.

6. The Braille printing head 12/12'/12" of embodiment 4 or 5, wherein said at least one strike pin component 5/41 comprises a strike pin grasping member 5 extending outward from said strike pin rod 44.

7. The Braille printing head 12/12'/12" of any one of embodiments 4 to 6, wherein said at least one strike pin component 5/41 comprises a strike pin grasping member 5 extending outward from said strike pin rod 44 and along a length of said strike pin rod 44.

8. The Braille printing head 12/12'/12" of embodiment 4 or 5, wherein said at least one strike pin component 5/41 comprises a strike pin gear 41 positioned along said strike pin rod 44.

9. A Braille printing head 12/12'/12" capable of forming Braille characters on a paper substrate 13, said Braille printing head 12/12'/12" comprising: a plurality of strike pins 4/4'/4", wherein each strike pin 4" within said plurality of strike pins 4" comprises a strike pin rod 44 having a circular cross-sectional area and an outer rod surface 45, a strike pin impact end 61 for forming a dot of a Braille character, a strike pin rod distal end 62 opposite said strike pin impact end 61, a hollow strike pin tubular member 63 sized so that said strike pin rod distal end 62 and a portion of said strike pin rod proximate said strike pin rod distal end 62 can slide within said hollow strike pin tubular member 63, and a strike pin holding flap member 47, positioned along said hollow strike pin tubular member 63, said strike pin holding flap member 47 being expandable so as to move between (i) a closed locked position in which said strike pin rod 44 is at a fixed location within said hollow strike pin tubular member 63 and (ii) an open unlocked position in which said strike pin rod 44 is slidingly movable within said hollow strike pin tubular member 63.

10. The Braille printing head 12/12'/12" of any one of embodiments 2 to 9, further comprising: an impact substrate 9/9'/9" having at least one strike pin hole 91/91'/91" therein for each strike pin 4/4'/4" within said plurality of strike pins 4/4'/4" to extend through; and a force-providing component 1, said force-providing component 1 being positioned to apply a force onto said impact substrate 9/9'/9" so as to move (i) said impact substrate 9/9'/9" and (ii) one or more selected strike pins **4*s*/4*s*'/4*s*" within said plurality of strike pins 4/4'/4" that are engaged with or connected to said impact substrate 9/9'/9" towards a paper substrate 13 to impact the paper substrate 13** and form a Braille character.

11. The Braille printing head 12/12'/12" of embodiment 1 or 10, wherein said one or more selected strike pins 4s/4s'/4s" within said plurality of strike pins 4/4'/4" that are engaged with said impact substrate 9/9'/9" when said impact substrate 9/9'/9" moves towards a paper substrate 13 to impact the paper substrate 13 and form a Braille character.

12. The Braille printing head 12/12'/12" of embodiment 11, wherein said plurality of strike pins 4/4'/4" comprise said plurality of strike pins 4/4'/4" within the Braille printing head 12/12'/12" of any one of embodiments 2 to 9.

13. The Braille printing head 12/12'/12" of embodiment 1 or 12, wherein said one or more selected strike pins 4s/4s'/4s" within said plurality of strike pins 4/4'/4" that are connected to said impact substrate 9/9'/9" when said impact substrate 9/9'/9" moves towards a paper substrate 13 to impact the paper substrate 13 and form a Braille character.

14. The Braille printing head 12/12'/12" of embodiment 13, wherein said plurality of strike pins 4/4'/4" comprises said plurality of strike pins 4" within the Braille printing head 12" of embodiment 9.

15. The Braille printing head 12/12'/12" of any one of embodiments 1 to 14, wherein each strike pin 4/4'/4" within said plurality of strike pins 4/4'/4" independently has a strike pin length that is equal to or different from a strike pin length of at least one other strike pin 4/4'/4" within said plurality of strike pins 4/4'/4". As used herein, the term "strike pin length" encompasses both (i) an overall strike pin length, as well as (ii) a length of a strike pin extending out of a printer head housing or below said impact substrate 9/9'/9".

16. The Braille printing head 12/12'/12" of embodiment 15, wherein each strike pin 4/4'/4" within said plurality of strike pins 4/4'/4" independently has a substantially equal strike pin length (i.e., (i) an overall strike pin length, or (ii) a length of a strike pin extending out of a printer head housing or below said impact substrate 9/9'/9").

17. The Braille printing head 12/12'/12" of embodiment 15, wherein at least two strike pins 4/4'/4" within said plurality of strike pins 4/4'/4" have a strike pin length that differs from one other.

18. The Braille printing head 12/12'/12" of any one of embodiments 1 to 17, wherein said plurality of strike pins 4/4'/4" comprises up to six independent strike pins 4/4'/4".

19. The Braille printing head 12/12'/12" of any one of embodiments 1 to 18, wherein said plurality of strike pins 4/4'/4" comprises six independent strike pins 4/4'/4" arranged in a 2×3 array of three rows with two strike pins 4/4'/4" in each row.

20. The Braille printing head 12/12'/12" of any one of embodiments 1 to 19, wherein each strike pin 4/4'/4" within said plurality of strike pins 4/4'/4" are spaced from one another by a distance equal to the distance between dots within a Braille character.

21. The Braille printing head 12/12'/12" of embodiment 19 or 20, wherein the strike pins 4/4'/4" within an uppermost row and a lowermost row have a strike pin length greater than strike pins 4/4'/4" within a middle row (or a length extending out of Braille printing head 12/12'/12" or below impact substrate 9/9'/9").

22. The Braille printing head 12/12'/12" of any one of embodiments 1 and 10 to 21, further comprising at least one impact substrate spring 146, which applies a return force on said impact substrate 9/9'/9" so as to return said impact substrate 9/9'/9" to its original non-printing position once said force-providing component 1 stops an attracting force on said impact substrate 9/9'/9".

23. The Braille printing head 12/12'/12" of any one of embodiments 1 and 10 to 22, wherein each strike pin hole 91/91'/91" within said impact substrate 9/9'/9" has a circular cross-sectional hole configuration.

24. The Braille printing head 12/12'/12" of any one of embodiments 1 and 10 to 22, wherein (1) each strike pin 4/4'comprising a strike pin rod 44 having a circular cross-sectional area and an outer rod surface 45, a strike pin impact end 61 for forming a dot of a Braille character, and two strike pin extensions 42/43/42'/43' extending outward from said outer rod surface 45, said two strike pin extensions 42/43/42'/43' being spaced apart from one another along said strike pin rod 44 so as to be positionable on opposite sides of said impact substrate 9/9'/9" upon impact with the paper substrate 13; and (2) each strike pin hole 91/91'/91" within said impact substrate 9/9'/9" has a cross-sectional hole configuration that allows at least one of said two strike pin extensions 42/43/42'/43' to extend therethrough.

25. The Braille printing head 12/12'/12" of embodiment 24, wherein each strike pin hole 91/91'/91" within said impact substrate 9/9'/9" has an oval cross-sectional hole configuration. It should be understood that each strike pin hole 91/91'/91" within said impact substrate 9/9'/9" could have any other cross-sectional hole configuration that allows at least one of said two strike pin extensions 42/43/42'/43' to extend therethrough. Other cross-sectional hole configurations include, but are not limited to, a rectangular hole, a triangular hole, a square hole, a star-shaped hole, a polygonal shaped hole, etc.

26. The Braille printing head 12/12'/12" of embodiment 24, wherein each strike pin hole 91/91'/91" within said impact substrate 9/9'/9" has a circular cross-sectional hole configuration with a notch 94 positioned along the circular cross-sectional hole configuration, said notch 94 being sized to allow said strike pin rod 44 with said two strike pin extensions 42/43/42'/43' to extend therethrough.

27. The Braille printing head 12/12'/12" of any one of embodiments 1 and 10 to 26, further comprising a control component 8 for each strike pin 4/4'/4" within said plurality of strike pins 4/4'/4", said control component 8 being capable of selecting one or more strike pins 4/4'/4" within said plurality of strike pins 4/4'/4".

28. The Braille printing head 12/12'/12" of embodiment 27, wherein said control component 8 (i) causes rotation of a selected strike pin **4*s*/4*s*'/4*s*" within said plurality of strike pins 4/4'/4", (ii) causes movement of at least a portion of a selected strike pin 4*s*/4*s*'/4*s*" within said plurality of strike pins 4/4'/4" in a direction along a dissecting axis A of the selected strike pin 4*s*/4*s*'/4*s*"**, or (iii) both (i) and (ii).

29. The Braille printing head 12/12'/12" of embodiment 27 or 28, wherein said control component 8 causes rotation of a selected strike pin **4*s*/4*s*'/4*s*" within said plurality of strike pins 4/4'/4"**.

30. The Braille printing head 12/12'/12" of embodiment 29, wherein said control component 8 rotates a component gear 51, which rotates the selected strike pin **4*s*' within said plurality of strike pins 4/4'/4"**.

31. The Braille printing head 12/12'/12" of any one of embodiments 27 to 30, wherein said control component 8 causes movement of at least a portion of a selected strike pin **4*s*/4*s*'/4*s*" within said plurality of strike pins 4/4'/4" in a direction along a dissecting axis A of the selected strike pin 4*s*/4*s*'/4*s*"**.

32. The Braille printing head 12/12'/12" of any one of embodiments 27 to 31, wherein said control component 8 comprises an electromagnet, motor, solenoid, actuator, or other electronic component that may be programmed to receive a control signal and act on a given strike pin 4/4'/4" in response to receiving the control signal.

33. The Braille printing head 12/12'/12" of any one of embodiments 27 to 32, wherein said control component 8 comprises a low voltage electromagnet, motor, solenoid, actuator, or electronic component. As used herein, the term "low voltage" represents a voltage of less than about 5.0 volts (or any number of volts greater than 0 up to and including 5.0 volts, in increments of 0.1 volts, e.g., 3.4 volts, or any range of volts between about 0.1 volts and about 5.0 volts, in increments of 0.1 volts, e.g., from about 3.1 volts to 5.2 volts), typically, from about 1.0 to about 5.0 volts, more typically, from about 3.0 to about 5.0 volts.

34. The Braille printing head 12/12'/12" of any one of embodiments 27 to 33, wherein said control component 8 comprises a low voltage electromagnet 8.

35. The Braille printing head 12/12'/12" of any one of embodiments 27 to 34, further comprising a pin plate 52 positioned between each control component 8 and an impact end portion 61 of each strike pin 4/4'/4", said pin plate 52 having pin plate holes 53/54/56 therein so that a portion of each strike pin 4/4'/4" within said plurality of strike pins 4/4'/4" can extend therethrough.

36. The Braille printing head 12/12'/12" of embodiment 35, wherein said pin plate 52 comprises first holes 53 to hold each control component in place, and second holes 54 to support a vertical position and portion of each strike pin 4/4'/4".

37. The Braille printing head 12/12'/12" of embodiment 35, wherein said pin plate 52 further comprises a cylindrical hollow structure 55 positioned below and/or along a lower surface 154 of said pin plate 52 below each pin plate hole 56, said cylindrical hollow structure 55 being sized to house at least a portion of a strike pin holding flap member 47 of a given strike pin 4".

38. The Braille printing head 12/12'/12" of embodiment 37, wherein said plurality of strike pins 4/4'/4" comprise the plurality of strike pins 4" recited in embodiment 9, and said strike pin holding flap member 47 being expandable so as to move between (i) a closed locked position in which said strike pin rod 44 is at a fixed location within said hollow strike pin tubular member 63 and a first portion 471 of said strike pin holding flap member 47 is positioned within said cylindrical hollow structure 55 so as to keep said strike pin holding flap member 47 in said closed locked position (ii) an open unlocked position in which said strike pin rod 44 is slidingly movable within said hollow strike pin tubular member 63 and said first portion 471 of strike pin holding flap member 47 is positioned outside of said cylindrical hollow structure 55 so as to allow said first portion 471 of said strike pin holding flap member 47 to expand.

39. The Braille printing head 12/12'/12" of any one of embodiments 35 and 37 to 38, further comprising a component plate 57, said component plate 57 containing a plurality of component plate holes 58 to hold control components 8 in place; said component plate 57 positioned between each control component 8 and said pin plate 52.

40. The Braille printing head 12/12'/12" of embodiment 39, wherein each strike pin 4" further comprises an enlarged end strike pin portion 68 positioned below said component plate 57.

41. The Braille printing head 12/12'/12" of embodiment 40, further comprising a pin spring 46 positioned along each strike pin 4/4'/4" between (i) a lower surface 78 of said enlarged end strike pin portion 68 and (ii) an upper surface 69 of said pin plate 52'.

42. The Braille printing head 12/12'/12" of any one of embodiments 39 to 41, wherein each strike pin 4" further comprises a strike pin portion 79 that provides a stop for said strike pin 4" along an upper surface 99 of said impact substrate 9".

43. The Braille printing head 12/12'/12" of any one of embodiments 1 and 10 to 42, wherein said force-providing component 1 comprises a force-providing electromagnet, a force-providing motor, a force-providing solenoid, a force-providing actuator, or other force-providing electronic component that may be programmed to receive a control signal and provide a moving force on said impact substrate 9/9'/9" in response to receiving the control signal.

44. The Braille printing head 12/12'/12" of embodiment 43, wherein said force-providing component 1 comprises a low voltage force-providing electromagnet, a low voltage force-providing motor, a low voltage force-providing solenoid, a low voltage force-providing actuator, or a low voltage force-providing electronic component.

45. The Braille printing head 12/12'/12" of embodiment 43 or 44, wherein said force-providing component 1 comprises a low voltage force-providing electromagnet.

46. The Braille printing head 12/12'/12" of any one of embodiments 43 to 45, wherein said force-providing component 1 comprises a single force-providing component that moves (i) said impact substrate 9/9'/9" and (ii) said one or more selected strike pins **4*s*/4*s*'/4*s*" within said plurality of strike pins 4/4'/4" that are engaged with or connected to said impact substrate 9/9'/9"**.

47. The Braille printing head 12/12'/12" of any one of embodiments 1 and 10 to 46, further comprising a printing head frame 60, said impact substrate 9/9'/9" being a component within said printing head frame 60 that moves independently of said printing head frame 60.

48. The Braille printing head 12/12'/12" of any one of embodiments 1 and 10 to 46, further comprising a printing head frame 60, said impact substrate 9/9'/9" comprising a component of said printing head frame 60 that moves with said printing head frame 60.

49. The Braille printing head 12/12'/12" of any one of embodiments 1 to 48, further comprising an outer body 122, said outer body housing 122 at least a portion of each component recited in embodiments 1 to 48.

50. The Braille printing head 12/12'/12" of any one of embodiments 1 to 49, wherein said printing head 12/12'/12" comprises an aluminum body 122 which acts as a heat sink.

51. A Braille printing head 12/12'/12" for a Braille printer for engraving Braille characters on a paper 13, said printing head 12 comprising: an aluminum body 122 wherein the aluminum body 122 act as heat sink; a plurality of strike pins 4; a plurality of first extension pins 6 of control pins 7 used to move said strike pins 4; a plurality of second extension pins 5, wherein the first extension pins 6 and the second extension pins 5 are connected such that the second extension pin 5 moves with movement of the first extension pin 6, and one or more selected first extension pins 6 move the corresponding second pins 5 and the corresponding strike pins 4 according to the Braille character to be printed; a force electromagnet 1; and an impact substrate 9 comprising a metallic flap 9, wherein the metallic flap 9 is capable of being pulled by the force electromagnet 1, and when pulled, the metallic flap 9 takes forward the selected strike pins **4*s***.

52. The Braille printing head 12/12'/12" of embodiment 51, wherein the strike pins 4 striking tangent of a printer roller 14 near to the printing head 12 is shorter in length as compared to the strike pins 4 striking other tangents of the printer roller 14, wherein each strike pin 4 is parallel to each other.

53. The Braille printing head 12/12'/12" of embodiment 51 or 52, wherein all of said selected strike pins 4 are driven by only one force electromagnet 1.

54. The Braille printing head 12/12'/12" of any one of embodiments 51 to 53, wherein mechanical pulling of the metallic flap 9 can be implemented by using a solenoid 1.

55. The Braille printing head 12/12'/12" of any one of embodiments 51 to 54, wherein a small mass (not shown) is attached at the lower most point of the metallic flap 9, which helps the selected strike pins **4*s*** to gain momentum and strike with greater force.

56. The Braille printing head of 12/12'/12" any one of embodiments 51 to 55, wherein the strike pins 4 can be driven by controlled gears 41 and motors 8 or any mechanism that can select the required strike pins **4*s***.

57. The Braille printing head 12/12'/12" of any one of embodiments 51 to 56, wherein the metallic flap 9 can be in any position and can be pulled or pushed to give momentum to strike pins **4*s***.

58. The Braille printing head 12/12'/12" of any one of embodiments 1 to 57, wherein said printing head 12/12'/12" is controlled by a microcontroller (not shown) that receives print command from a computer (not shown) or an application processor (not shown) or an integrated computer (not shown).

59. The Braille printing head 12/12'/12" of any one of embodiments 1 to 58, further comprising a print substrate 13, said print substrate 13 being positionable proximate said Braille printing head 12/12'/12" so as to support paper 13 therebetween.

60. The Braille printing head 12/12'/12" of embodiment 59, wherein said print substrate 14 comprises a printer roller 11.

61. The Braille printer head 12/12'/12" of embodiment 60, wherein the printer roller 14 comprises a rubber roller 11 or a roller 11 suitable for use in a dot matrix printer.
62. The Braille printing head 12/12'/12" of any one of embodiments 59 to 61, wherein said print substrate 14 comprises a printer roller 11, and a cylindrical metal sleeve 10 positioned over the printer roller 11, said cylindrical metal sleeve 10 having a plurality of engraved divots (or holes) 15 therein, said plurality of engraved divots (or holes) 15 having a divot size similar to a standard Braille dot size.
63. The Braille printing head 12/12'/12" of embodiment 59, wherein said print substrate 14 comprises a flat surface 141 having a plurality of engraved divots 15 therein, said plurality of engraved divots 15 having a divot size similar to a standard Braille dot size.
64. The Braille printing head 12/12'/12" of embodiment 63, wherein said print substrate 14 comprises a metallic plate.
65. A Braille printer (not shown)(or Braille printer system such as exemplary Braille print systems 100/200/300) comprising the Braille printing head 12/12'/12" of any one of embodiments 1 to 64.
66. The Braille printer of embodiment 65, wherein said Braille printing head 12/12'/12" is positioned and movable along a printer head rod (not shown).
67. The Braille printer of embodiments 65 or 66, further comprising a printer motor (not shown); and a driver circuit (not shown).
68. The Braille printer of any one of embodiments 65 to 67, further comprising a computer (not shown) or an application processor (not shown) or an integrated computer (not shown) capable of sending control signals to said Braille printing head 12/12'/12" and any other signal-receiving printer components.
69. The Braille printer of any one of embodiments 65 to 68, further comprising a Braille printer application for running all features of said Braille printer.
70. The Braille printer of any one of embodiments 65 to 69, further comprising an integrated computer with a touch screen (not shown) to provide user interface.
71. The Braille printer of any one of embodiments 65 to 70, further comprising features comprising speech to text recognition software for various languages, audio book recording and listening, or any combination thereof.
72. A method of making the Braille printing head 12/12'/12" of any one of embodiments 1 to 64 or the Braille printer of any one of embodiments 65 to 71, said method comprising: positioning the plurality of strike pins 4/4'/4", the impact substrate 9/9'/9", and the force-providing component 1 relative to one another so that the force-providing component can apply a force onto the impact substrate 9/9'/9" so as to move (i) the impact substrate 9/9'/9" and (ii) one or more selected strike pins **4*s*/4*s*'/4*s*" within the plurality of strike pins 4/4'/4" that are engaged with or connected to the impact substrate 9/9'/9" towards a paper substrate 13 to impact the paper substrate 13** and form a Braille character.
73. A method of using the Braille printing head 12/12'/12" of any one of embodiments 1 to 64 or the Braille printer (not shown) of any one of embodiments 65 to 71, said method comprising: printing one or more Braille characters onto a piece of paper 13.

The present invention is further illustrated by the following examples, which are not to be construed in any way as imposing limitations upon the scope thereof. On the contrary, it is to be clearly understood that resort may be had to various other embodiments, modifications, and equivalents thereof which, after reading the description herein, may suggest themselves to those skilled in the art without departing from the spirit of the present invention and/or the scope of the appended claims.

EXAMPLE 1

Preparation of Exemplary Braille Printer Head and Printers

Exemplary Braille printer heads and printers as shown in FIGS. **1-27*b*** and discussed above were prepared using various printer head-forming steps. The resulting Braille printer heads and printers were used to form Braille characters on various paper substrates.

It should be understood that although the above-described Braille printer heads and printers and/or methods are described as "comprising" one or more components or steps, the above-described Braille printer heads and printers and/or methods may "comprise," "consists of" or "consist essentially of" the above-described components, features or steps of the Braille printer heads and printers and/or methods. Consequently, where the present invention, or a portion thereof, has been described with an open-ended term such as "comprising," it should be readily understood that (unless otherwise stated) the description of the present invention, or the portion thereof, should also be interpreted to describe the present invention, or a portion thereof, using the terms "consisting essentially of" or "consisting of" or variations thereof as discussed below.

As used herein, the terms "comprises," "comprising," "includes," "including," "has," "having," "contains", "containing," "characterized by" or any other variation thereof, are intended to encompass a non-exclusive inclusion, subject to any limitation explicitly indicated otherwise, of the recited components. For example, a Braille printer head and/or printer and/or method that "comprises" a list of elements (e.g., components, features, or steps) is not necessarily limited to only those elements (or components or steps), but may include other elements (or components or steps) not expressly listed or inherent to the Braille printer head and/or printer and/or method.

As used herein, the transitional phrases "consists of" and "consisting of" exclude any element, step, or component not specified. For example, "consists of" or "consisting of" used in a claim would limit the claim to the components, materials or steps specifically recited in the claim except for impurities ordinarily associated therewith (i.e., impurities within a given component). When the phrase "consists of" or "consisting of" appears in a clause of the body of a claim, rather than immediately following the preamble, the phrase "consists of" or "consisting of" limits only the elements (or components or steps) set forth in that clause; other elements (or components) are not excluded from the claim as a whole.

As used herein, the transitional phrases "consists essentially of" and "consisting essentially of" are used to define a Braille printer head and/or printer and/or method that includes materials, steps, features, components, or elements, in addition to those literally disclosed, provided that these additional materials, steps, features, components, or elements do not materially affect the basic and novel characteristic(s) of the claimed invention. The term "consisting essentially of" occupies a middle ground between "comprising" and "consisting of".

Further, it should be understood that the herein-described Braille printer heads and printers and/or methods may comprise, consist essentially of, or consist of any of the herein-described components, features and steps, as shown in the figures with or without any feature(s) not shown in the figures. In other words, in some embodiments, the Braille printer heads and printers and/or methods of the present invention do not have any additional features other than those shown in the figures, and such additional features, not shown in the figures, are specifically excluded from the Braille printer heads and printers and/or methods. In other embodiments, the Braille printer heads and printers and/or methods of the present invention do have one or more additional features that are not shown in the figures.

While the specification has been described in detail with respect to specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A Braille printing head capable of forming Braille characters on a paper substrate, said Braille printing head comprising:

a plurality of strike pins, wherein each strike pin within said plurality of strike pins comprises a strike pin rod having a circular cross-sectional area and an outer rod surface, a strike pin impact end for forming a dot of a Braille character, a strike pin rod distal end opposite said strike pin impact end, a hollow strike pin tubular member sized so that said strike pin rod distal end and a portion of said strike pin rod proximate said strike pin rod distal end can slide within said hollow strike pin tubular member, and a strike pin holding flap member, positioned along said hollow strike pin tubular member, said strike pin holding flap member being expandable so as to move between (i) a closed locked position in which said strike pin rod is at a fixed location within said hollow strike pin tubular member and (ii) an open unlocked position in which said strike pin rod is slidingly movable within said hollow strike pin tubular member;

an impact substrate having at least one strike pin hole therein for each strike pin within said plurality of strike pins to extend through; and a control component for each strike pin within said plurality of strike pins, said control component being capable of (i) selecting one or more strike pins within said plurality of strike pins, and (ii) causing movement of at least a portion of a selected strike pin within said plurality of strike pins in a direction along a dissecting axis A of the selected strike pin.

2. The Braille printing head of claim 1, wherein said plurality of strike pins comprises up to six independent strike pins.

3. The Braille printing head of claim 1, wherein said control component comprises an electromagnet, motor, a solenoid, an actuator, or other electronic component that may be programmed to receive a control signal and act on a given strike pin in response to receiving the control signal.

4. The Braille printing head of claim 3, wherein said control component comprises a solenoid.

5. The Braille printing head of claim 1, further comprising a pin plate positioned between each control component and an impact end portion of each strike pin, said pin plate having pin plate holes therein so that a portion of each strike pin within said plurality of strike pins can extend therethrough.

6. The Braille printing head of claim 5, wherein said pin plate further comprises a cylindrical hollow structure positioned below and/or along a lower surface of said pin plate below each pin plate hole, said cylindrical hollow structure being sized to house at least a portion of a strike pin holding flap member of a given strike pin.

7. The Braille printing head of claim 6, wherein said strike pin holding flap member being expandable so as to move between (i) a closed locked position in which said strike pin rod is at a fixed location within said hollow strike pin tubular member and a first portion of said strike pin holding flap member is positioned within said cylindrical hollow structure so as to keep said strike pin holding flap member in said closed locked position, and (ii) an open unlocked position in which said strike pin rod is slidingly movable within said hollow strike pin tubular member and said first portion of strike pin holding flap member is positioned outside of said cylindrical hollow structure so as to allow said first portion of said strike pin holding flap member to expand.

8. The Braille printing head of claim 5, further comprising a component plate, said component plate containing a plurality of component plate holes to hold control components in place; said component plate positioned between each control component and said pin plate.

9. The Braille printing head of claim 8, wherein each strike pin further comprises an enlarged end strike pin portion positioned below said component plate.

10. The Braille printing head of claim 9, further comprising a pin spring positioned along each strike pin between (i) a lower surface of said enlarged end strike pin portion and (ii) an upper surface of said pin plate.

11. The Braille printing head of claim 1, further comprising a print substrate, said print substrate (i) being positionable proximate said Braille printing head so as to support paper therebetween, and (ii) comprising a rubber roller or a roller suitable for use in a dot matrix printer.

12. The Braille printing head of claim 1, wherein said control component moves the selected strike pin towards a paper substrate to impact the paper substrate and form a Braille character.

13. A Braille printer comprising the Braille printing head of claim 1.

14. A method of using the Braille printing head of claim 1, said method comprising:

printing one or more Braille characters onto a piece of paper.

15. A Braille printing head capable of forming Braille characters on a paper substrate, said Braille printing head comprising:

a plurality of strike pins, wherein each strike pin within said plurality of strike pins comprises a strike pin rod having a circular cross-sectional area and an outer rod surface, a strike pin impact end for forming a dot of a Braille character, a strike pin rod distal end opposite said strike pin impact end, a hollow strike pin tubular member sized so that said strike pin rod distal end and a portion of said strike pin rod proximate said strike pin rod distal end can slide within said hollow strike pin tubular member, and a strike pin holding flap member, positioned along said hollow strike pin tubular member, said strike pin holding flap member being expandable so as to move between (i) a closed locked position in which said strike pin rod is at a fixed location within said hollow strike pin tubular member and (ii) an open unlocked position in which said strike pin rod is slidingly movable within said hollow strike pin tubular member; and a control component for each strike pin within said plurality of strike pins, said control component being capable of (i) selecting one or more strike pins within said plurality of strike pins, and (ii) causing movement of at least a portion of a selected strike pin within said plurality of strike pins in a direction along a dissecting axis A of the selected strike pin.

16. The Braille printing head of claim 15, wherein said control component comprises an electromagnet, motor, a solenoid, an actuator, or other electronic component that may be programmed to receive a control signal and act on a given strike pin in response to receiving the control signal.

17. The Braille printing head of claim 15, further comprising a pin plate positioned between each control component and an impact end portion of each strike pin, said pin plate having pin plate holes therein so that a portion of each strike pin within said plurality of strike pins can extend therethrough.

18. A Braille printer comprising the Braille printing head of claim 15.

19. A method of using the Braille printing head of claim 15, said method comprising:

printing one or more Braille characters onto a piece of paper.

* * * * *